US010262783B2

(12) United States Patent
Yokoyama

(10) Patent No.: US 10,262,783 B2
(45) Date of Patent: Apr. 16, 2019

(54) STACK-TYPE INDUCTOR ELEMENT AND METHOD OF MANUFACTURING THE SAME, AND COMMUNICATION DEVICE

(71) Applicant: Murata Manufacturing Co., Ltd., Nagaokakyo-shi, Kyoto-fu (JP)

(72) Inventor: Tomoya Yokoyama, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 342 days.

(21) Appl. No.: 15/012,931

(22) Filed: Feb. 2, 2016

(65) Prior Publication Data

US 2016/0148740 A1 May 26, 2016

Related U.S. Application Data

(63) Continuation of application No. 14/205,406, filed on Mar. 12, 2014, now Pat. No. 9,287,625.

(30) Foreign Application Priority Data

Mar. 18, 2013 (JP) ..... 2013-054613
Feb. 6, 2014 (JP) ..... 2014-021305

(51) Int. Cl.

| | |
|---|---|
| ***H01Q 1/00*** | (2006.01) |
| ***H01F 17/04*** | (2006.01) |
| ***H01F 41/04*** | (2006.01) |
| ***H01Q 7/06*** | (2006.01) |
| ***H01F 17/00*** | (2006.01) |
| ***H01Q 7/08*** | (2006.01) |

(52) U.S. Cl.

CPC ..... *H01F 17/04* (2013.01); *H01F 17/0013* (2013.01); *H01F 41/041* (2013.01); *H01Q 7/06* (2013.01); *H01Q 7/08* (2013.01); *H01F 2017/0066* (2013.01); *Y10T 29/4902* (2015.01)

(58) Field of Classification Search

CPC ..... H01Q 1/38; H01Q 7/06; H01Q 7/08
USPC ..... 343/336, 787, 850; 866/117, 222
See application file for complete search history.

(56) References Cited

U.S. PATENT DOCUMENTS

2002/0008606 A1* 1/2002 Okuyama ..... H01F 17/0013 336/200
2010/0194498 A1* 8/2010 Isoshima ..... H01G 4/232 333/185
2012/0091210 A1* 4/2012 Koujima ..... G06K 19/07749 235/492

OTHER PUBLICATIONS

Yokoyama, "Stack-Type Inductor Element and Method of Manufacturing the same, and Communication Device", U.S. Appl. No. 14/205,406, filed Mar. 12, 2014.

* cited by examiner

*Primary Examiner* — Dameon E Levi
*Assistant Examiner* — Collin Dawkins
(74) *Attorney, Agent, or Firm* — Keating & Bennett, LLP

(57) ABSTRACT

A stack-type inductor element includes a stack including a magnetic element layer, a coil conductor pattern provided in the stack and the magnetic element layer defines a magnetic element core, a plurality of first pad electrodes provided on one main surface of the stack, and a plurality of second pad electrodes provided on the other main surface of the stack so as to be symmetric to the plurality of first pad electrodes. One end and the other end of the coil conductor pattern are electrically connected to two of the plurality of first pad electrodes, respectively, and the plurality of second pad electrodes are all electrically open.

11 Claims, 27 Drawing Sheets

PREPARE MOTHER SHEET

FORM THROUGH HOLE

FILL HOLE WITH CONDUCTIVE PASTE

FILL HOLE WITH CONDUCTIVE PASTE

PRINT CONDUCTOR PATTERN

STACK AND PRESS-BOND SHEETS

PREPARE PET FILM

TRANSFER

PREPARE MOTHER SHEET

FORM THROUGH HOLE

FILL HOLE WITH CONDUCTIVE PASTE

PRINT CONDUCTOR PATTERN

PREPARE MOTHER SHEET

PRINT PAD ELECTRODE

STACK AND PRESS-BOND SHEETS BS1' & BS2'

STACK AND PRESS-BOND SHEETS BS3' & BS4'

STACK AND PRESS-BOND IN SUCH POSITION
THAT MAGNETIC ELEMENT LAYERS FACE EACH OTHER

STACK-TYPE INDUCTOR ELEMENT AND METHOD OF MANUFACTURING THE SAME, AND COMMUNICATION DEVICE

BACKGROUND OF THE INVENTION

1. Field of the Invention

The present invention relates to a stack-type inductor element, and particularly to a stack-type inductor element including a stack obtained by stacking a magnetic element layer and a non-magnetic element layer and a conductor pattern located on opposing surfaces of the magnetic element layer which defines a portion of the inductor.

The present invention also relates to a manufacturing method of manufacturing such a stack-type inductor element.

The present invention further relates to a communication device including such a stack-type inductor element.

2. Description of the Related Art

Japanese Patent Laying-Open No. 2009-111197 (see, for example, paragraph 0052) and Japanese Patent Laying-Open No. 2009-231331 (see, for example, paragraphs 0033 and 0040) disclose one example of a stack-type inductor element of this type and a method of manufacturing the same. According to Japanese Patent Laying-Open No. 2009-111197, an adhesive film is provided on at least one surface of a sintered ferrite substrate. In addition, in order to provide a stack with a bending property, a fracture is formed in the substrate. Here, a fracture lowers permeability, however, permeability varies depending on a state of the fracture. Therefore, grooves are formed in the substrate with regularity and a fracture is formed in this groove portion. Thus, magnetic characteristics after formation of a fracture can be stabilized while a bending property is provided.

According to Japanese Patent Laying-Open No. 2009-231331, in order to divide a ceramic substrate into individual pieces of a stack, a division groove is formed in the ceramic substrate. Specifically, the division groove is formed by moving a scribing blade pressed against the other main surface of the ceramic substrate with a desired pressure. In succession, a roller pressed against one main surface of the ceramic substrate with a protection sheet being interposed is moved along the ceramic substrate. Thus, the ceramic substrate deforms to open the division groove, so that the ceramic substrate is divided along the division groove.

When a groove is formed in a substrate in a stage prior to firing, warpage is caused due to asymmetry between one main surface and the other main surface forming the substrate. This warpage may impair coplanarity of each element obtained by breakage (division into individual pieces) of the substrate and may become a factor interfering decrease in thickness.

SUMMARY OF THE INVENTION

Therefore, preferred embodiments of the present invention provide a stack-type inductor element having a smaller thickness and a method of manufacturing the same, and a communication device.

According to a preferred embodiment of the present invention, a stack-type inductor element includes a stack including a magnetic element layer, a coil conductor pattern provided in the stack and including the magnetic element layer as a magnetic element core, a plurality of first pad electrodes provided on one main surface of the stack, and a plurality of second pad electrodes provided on the other main surface of the stack to be symmetric to the plurality of first pad electrodes, one end and the other end of the coil conductor pattern are electrically connected to two of the plurality of first pad electrodes, respectively, and the plurality of second pad electrodes are all electrically open.

Preferably, the stack has a rectangular or substantially rectangular shape when viewed in a direction of stack of the stack and the plurality of first pad electrodes are arranged in two rows along a longitudinal direction of the stack.

Preferably, the number of the first pad electrodes is three or more and a pad electrode not connected to the coil conductor pattern of the plurality of first pad electrodes is each electrically open.

Preferably, the stack includes non-magnetic element layers arranged to be superimposed on opposing main surfaces of the magnetic element layer.

A method of manufacturing a stack-type inductor element according to another preferred embodiment of the present invention is a method of manufacturing a stack-type inductor element by dividing into division units, a substrate assembly including a structure sandwiching a magnetic element layer between a first outermost layer and a second outermost layer, the method including a first step of forming a plurality of first via holes passing through the first outermost layer, a second step of forming a plurality of first conductor patterns on an upper surface of the first outermost layer or a lower surface of the magnetic element layer, a third step of forming a plurality of second via holes passing through the magnetic element layer, a fourth step of forming a plurality of second conductor patterns on an upper surface of the magnetic element layer or a lower surface of the second outermost layer, a fifth step of performing an operation for forming a plurality of first pad electrodes on a lower surface of the first outermost layer and connecting two first pad electrodes to two respective points of the plurality of first conductor patterns through two first via holes for each division unit, a sixth step of forming a plurality of second pad electrodes on an upper surface of the second outermost layer so as to be symmetric to the plurality of first pad electrodes, and a seventh step of fabricating a plurality of inductors by spirally connecting the plurality of first conductor patterns and the plurality of second conductor patterns through the plurality of second via holes for each division unit.

Preferably, a ninth step of applying a blade of a scriber to a line defining the division unit and forming a groove in a longitudinal direction and a direction of a short side of the substrate assembly is further provided.

The substrate assembly preferably has a quadrangular or substantially quadrangular main surface, and the ninth step includes the steps of forming a first groove having a first depth along a long side of the quadrangle and forming a second groove having a second depth smaller than the first depth along a short side of the quadrangle.

A tenth step of firing the substrate assembly prior to the ninth step preferably is further provided.

Preferably, the fifth step includes the step of filling the plurality of first via holes with a first conductive material, and the seventh step includes the step of filling the plurality of second via holes with a second conductive material.

Preferably, the substrate assembly has a thickness not greater than about 0.6 mm, for example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
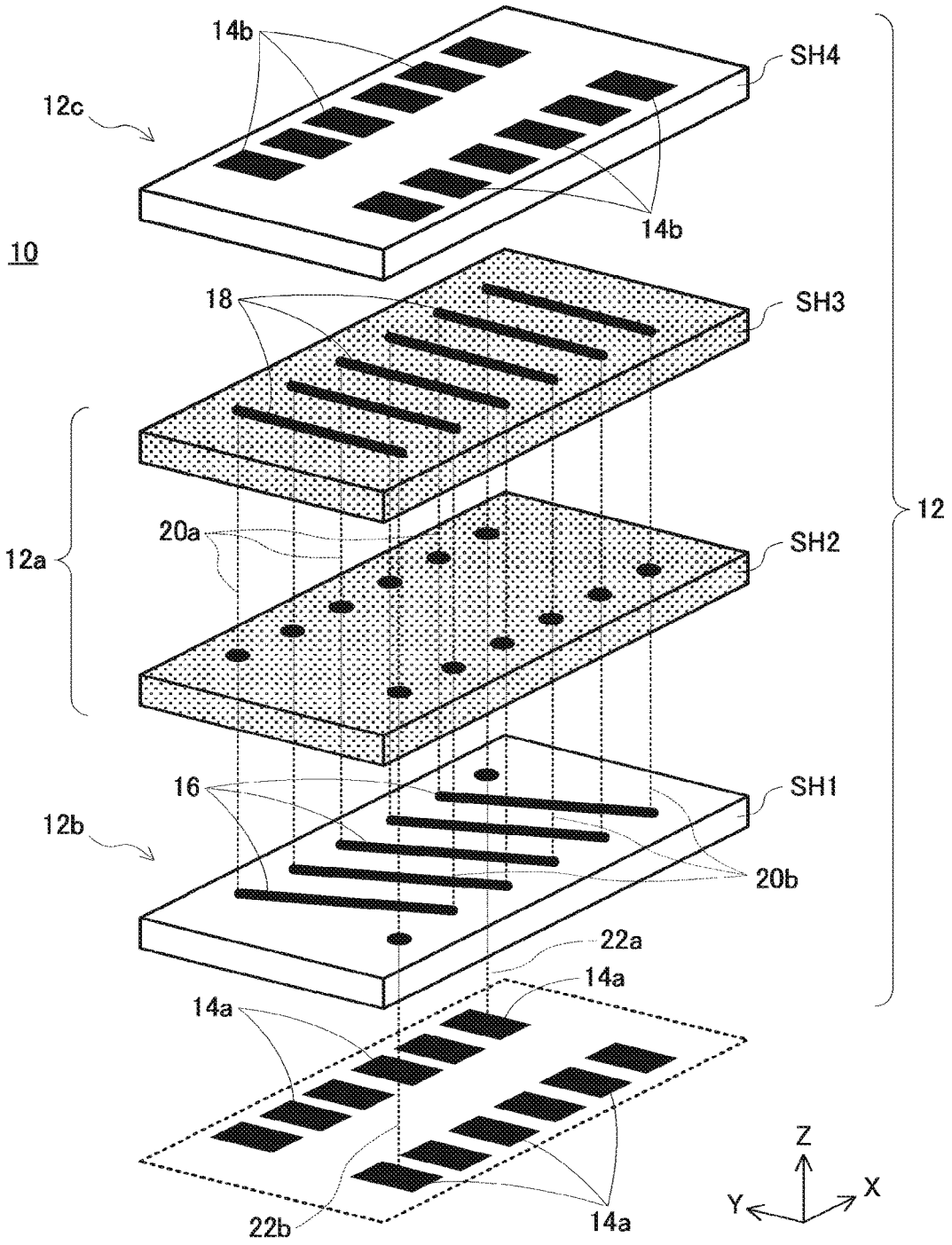
FIG. 1 is an exploded view showing a disassembled state of a stack-type inductor element according to a preferred embodiment of the present invention.

Referring to FIG. 1, a stack-type inductor element 10 according to a preferred embodiment of the present invention includes ceramic sheets SH1 to SH4 to define an antenna element for wireless communication in a 13.56 MHz band, for example, and stacked such that each main surface defines a quadrangular or substantially quadrangular shape. Ceramic sheets SH1 to SH4 preferably are equal or substantially equal in size of each main surface. Ceramic sheets SH1 and SH4 include a non-magnetic element, whereas ceramic sheets SH2 to SH3 include a magnetic element.

Consequently, a stack 12 defines a parallelepiped. Ceramic sheets SH2 to SH3 define a magnetic element layer 12*a*, ceramic sheet SH1 defines a non-magnetic element layer 12*b*, and ceramic sheet SH4 defines a non-magnetic element layer 12*c*. The stack 12 of the stack-type inductor element 10 has a stack structure such that magnetic element layer 12*a* is sandwiched between non-magnetic element layers 12*b* and 12*c*. A long side and a short side of the quadrangle defining the main surface (e.g., an upper surface or a lower surface) of stack 12 extend along an X axis and a Y axis respectively, and a thickness of stack 12 increases along a Z axis.

Figure 2A:
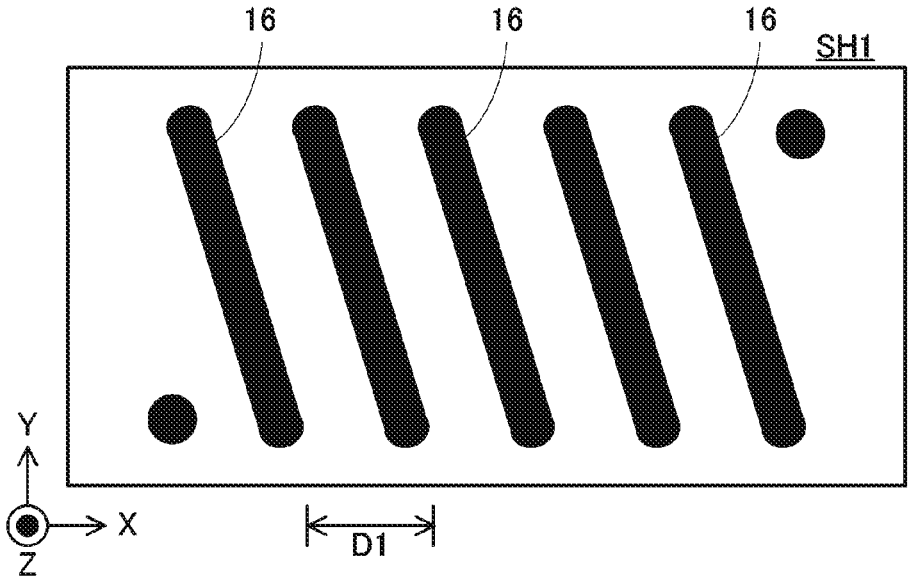
FIG. 2A is a plan view showing one example of a ceramic sheet SH1 of a stack-type inductor element.
Figure 2B:
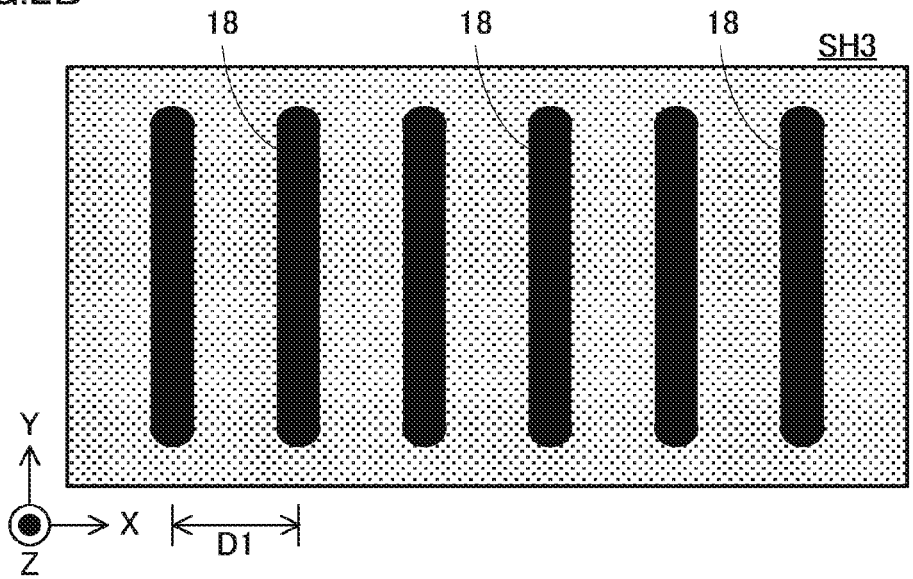
FIG. 2B is a plan view showing one example of a ceramic sheet SH3 of the stack-type inductor element.
Figure 3A:
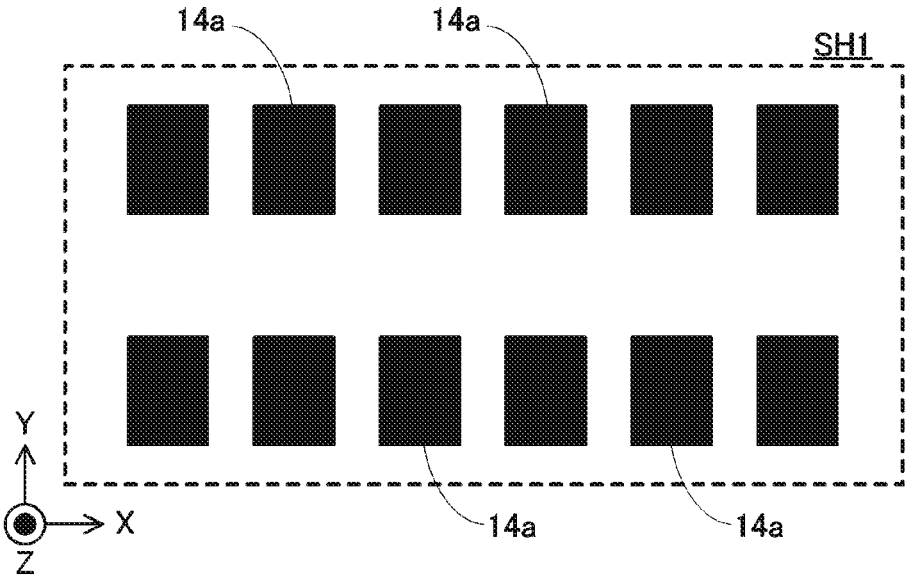
FIG. 3A is an illustrative diagram showing one example of a pad electrode provided on a lower surface of ceramic sheet SH1.
Figure 3B:
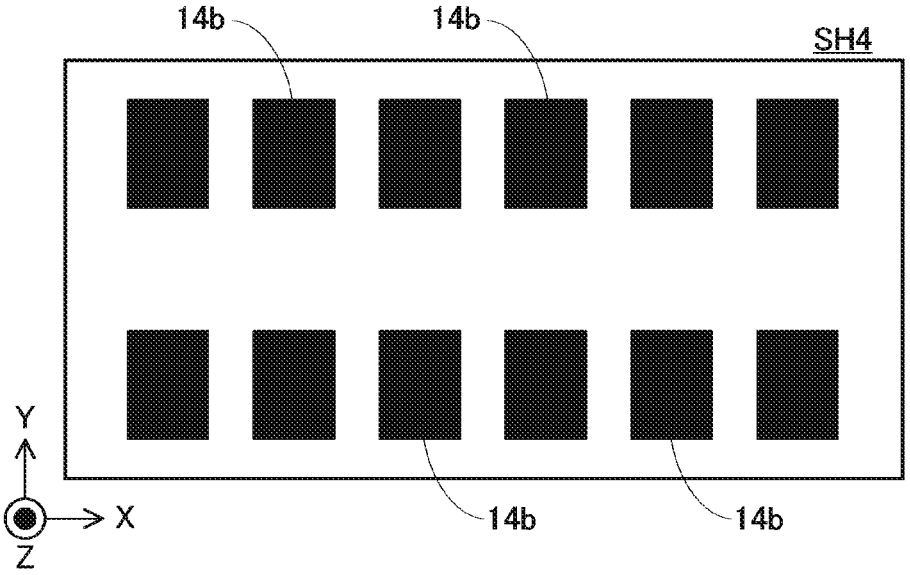
FIG. 3B is a plan view showing one example of a ceramic sheet SH4 of the stack-type inductor element.

As shown in FIGS. 2A to 2B, five linear conductors 16 are provided on an upper surface of ceramic sheet SH1, and six linear conductors 18 are provided on an upper surface of ceramic sheet SH3. In addition, as shown in FIGS. 3A to 3B, twelve pad electrodes 14*a* are provided on a lower surface of ceramic sheet SH1, and twelve pad electrodes 14*b* are provided on an upper surface of ceramic sheet SH4. It is noted that no linear conductor is present on an upper surface of ceramic sheet SH2 and a magnetic element appears over the entire upper surface.

Referring to FIG. 2A, linear conductors 16 defining a portion of a coil conductor pattern are aligned at a distance D1 in a direction of the X axis in a position extending obliquely to the Y axis. Opposing ends in a direction of length of linear conductor 16 remain inside of opposing ends in a direction of the Y axis of the upper surface of ceramic sheet SH1. Two linear conductors 16 and 16 on opposing sides in the direction of the X axis are arranged inside of the opposing ends in the direction of the X axis of the upper surface of ceramic sheet SH1.

Referring to FIG. 2B, linear conductors 18 defining a portion of a coil conductor pattern are aligned at distance D1 in the direction of the X axis in a position extending along the Y axis. Opposing ends in a direction of length of linear conductor 18 also remain inside of the opposing ends in the direction of the Y axis of the upper surface of ceramic sheet SH3. Two linear conductors 18 and 18 on opposing sides in the direction of the X axis are also arranged inside of the opposing ends in the direction of the X axis of the upper surface of ceramic sheet SH3.

A distance in the direction of the X axis from one end to the other end of linear conductor 16 corresponds to "D1". A position of one end of linear conductor 16 is adjusted to a position coinciding with one end of linear conductor 18 when viewed in a direction of the Z axis, and a position of the other end of linear conductor 16 is adjusted to a position coinciding with the other end of linear conductor 18 when viewed in the direction of the Z axis. The number of linear conductors 16 is smaller by one than the number of linear conductors 18.

Therefore, when viewed in the direction of the Z axis, linear conductors 16 and 18 are alternately aligned in the direction of the X axis. In addition, one end of linear conductor 16 coincides with one end of linear conductor 18, and the other end of linear conductor 16 coincides with the other end of linear conductor 18.

Referring to FIG. 3A, twelve pad electrodes 14*a* each include a main surface with a rectangular or substantially rectangular shape and they are equal or substantially equal to one another in a size of the main surface. Among these, six pad electrodes 14*a* extend at an equal or substantially equal interval along the X axis slightly inside of an end portion on a positive side in the direction of the Y axis, and six remaining pad electrodes 14*a* extend at an equal or substantially equal interval along the X axis slightly inside of an end portion on a negative side in the direction of the Y axis.

A distance from pad electrode 14*a* present on a most negative side in the direction of the X axis to the end portion on the negative side in the direction of the X axis of ceramic sheet SH1 is equal or substantially equal to a distance from pad electrode 14*a* present on a most positive side in the direction of the X axis to the end portion on the positive side in the direction of the X axis of ceramic sheet SH1. A distance from pad electrode 14*a* present on the most negative side in the direction of the Y axis to the end portion on the negative side in the direction of the Y axis of ceramic sheet SH1 is equal or substantially equal to a distance from pad electrode 14*a* present on the most positive side in the direction of the Y axis to the end portion on the positive side in the direction of the Y axis of ceramic sheet SH1.

Therefore, with a straight line extending along the X axis through the center in the direction of the Y axis of the main surface of ceramic sheet SH1 being defined as the reference, six pad electrodes 14*a* on the negative side in the direction of the Y axis relative to this straight line are configured in line symmetry to six pad electrodes 14*a* on the positive side in the direction of the Y axis relative to this straight line.

With a straight line extending along the Y axis through the center in the direction of the X axis of the main surface of ceramic sheet SH1 being defined as the reference, six pad electrodes 14*a* on the negative side in the direction of the X axis relative to this straight line are configured in line symmetry to six pad electrodes 14*a* on the positive side in the direction of the X axis relative to this straight line.

Referring to FIG. 3B, twelve pad electrodes 14*b* each include a main surface with a rectangular or substantially rectangular shape and they are equal or substantially equal to one another in a size of the main surface. Among these, six pad electrodes 14*b* extend at an equal or substantially equal interval along the X axis slightly inside of an end portion on a positive side in the direction of the Y axis, and six remaining pad electrodes 14*b* extend at an equal or substantially equal interval along the X axis slightly inside of an end portion on a negative side in the direction of the Y axis.

A distance from pad electrode 14*b* present on a most negative side in the direction of the X axis to the end portion on the negative side in the direction of the X axis of ceramic sheet SH4 is equal or substantially equal to a distance from pad electrode 14*b* present on a most positive side in the direction of the X axis to the end portion on the positive side in the direction of the X axis of ceramic sheet SH4. A distance from pad electrode 14*b* present on the most negative side in the direction of the Y axis to the end portion on the negative side in the direction of the Y axis of ceramic sheet SH4 is equal to a distance from pad electrode 14*b* present on the most positive side in the direction of the Y axis to the end portion on the positive side in the direction of the Y axis of ceramic sheet SH4.

Therefore, with a straight line extending along the X axis through the center in the direction of the Y axis of the main surface of ceramic sheet SH4 being defined as the reference, six pad electrodes 14*b* on the negative side in the direction of the Y axis relative to this straight line are configured in line symmetry to six pad electrodes 14*b* on the positive side in the direction of the Y axis relative to this straight line.

With a straight line extending along the Y axis through the center in the direction of the X axis of the main surface of ceramic sheet SH4 being defined as the reference, six pad electrodes 14*b* on the negative side in the direction of the X axis relative to this straight line are configured in line symmetry to six pad electrodes 14*b* on the positive side in the direction of the X axis relative to this straight line.

A size of the main surface of pad electrode 14*b* is also the same or substantially the same as a size of the main surface of pad electrode 14*a*, and a manner of arrangement of pad electrodes 14*b* at the main surface of ceramic sheet SH4 is the same as a manner of arrangement of pad electrodes 14*a* at the main surface of ceramic sheet SH1. Therefore, pad electrodes 14*b* are configured in mirror symmetry to pad electrodes 14*a*. When viewed in the direction of the Z axis, opposing ends of each linear conductor 18 coincide with two pad electrodes 14*a* and 14*a* aligned along the Y axis, and further coincide also with two pad electrodes 14*b* and 14*b* aligned along the Y axis.

Referring back to FIG. 1, via hole conductors 20*a* pass through magnetic element layer 12*a* in the direction of the Z axis at a position of one end of linear conductors 16 (the end portion on the positive side in the direction of the Y axis). Via hole conductors 20*b* pass through magnetic element layer 12*a* in the direction of the Z axis at a position of the other end of linear conductors 16 (the end portion on the negative side in the direction of the Y axis). This via hole conductor 20*a* defines a portion of a coil conductor pattern.

Linear conductors 16 are configured in a manner shown in FIG. 2A, and linear conductors 18 are configured in a manner shown in FIG. 2B. Therefore, via hole conductors 20*a* are connected to one ends (the end portion on the positive side in the direction of the Y axis) of five linear conductors 18 starting from the negative side in the direction of the X axis at the upper surface of ceramic sheet SH3. Via hole conductors 20*b* are connected to the other ends (the end portion on the negative side in the direction of the Y axis) of five linear conductors 18 starting from the positive side in the direction of the X axis at the upper surface of ceramic sheet SH3.

Consequently, linear conductors 16 and linear conductors 18 are spirally connected, and thus a coil conductor (a wound element) having the X axis as an axis of winding is provided. Since a magnetic element is present inside the coil conductor, the coil conductor defines and functions as an inductor. In this case, a portion of ceramic sheets SH2 and SH3 which are the magnetic element layers defines and serves as a magnetic element core.

A via hole conductor 22*a* passes through magnetic element layer 12*a* and non-magnetic element layer 12*b* in the direction of the Z axis at a position of one end of linear conductor 18 present on the most positive side in the direction of the X axis. Similarly, a via hole conductor 22*b* passes through magnetic element layer 12*a* and non-magnetic element layer 12*b* in the direction of the Z axis at a position of the other end of linear conductor 18 present on the most negative side in the direction of the X axis.

Via hole conductor 22*a* is connected to pad electrode 14*a* present on the most positive side in the direction of the X axis and on the positive side in the direction of the Y axis. Via hole conductor 22*b* is connected to pad electrode 14*a* present on the most negative side in the direction of the X axis and on the negative side in the direction of the Y axis. Thus, two different points of the inductor are connected to two pad electrodes 14*a* and 14*a*, respectively.

Figure 4:
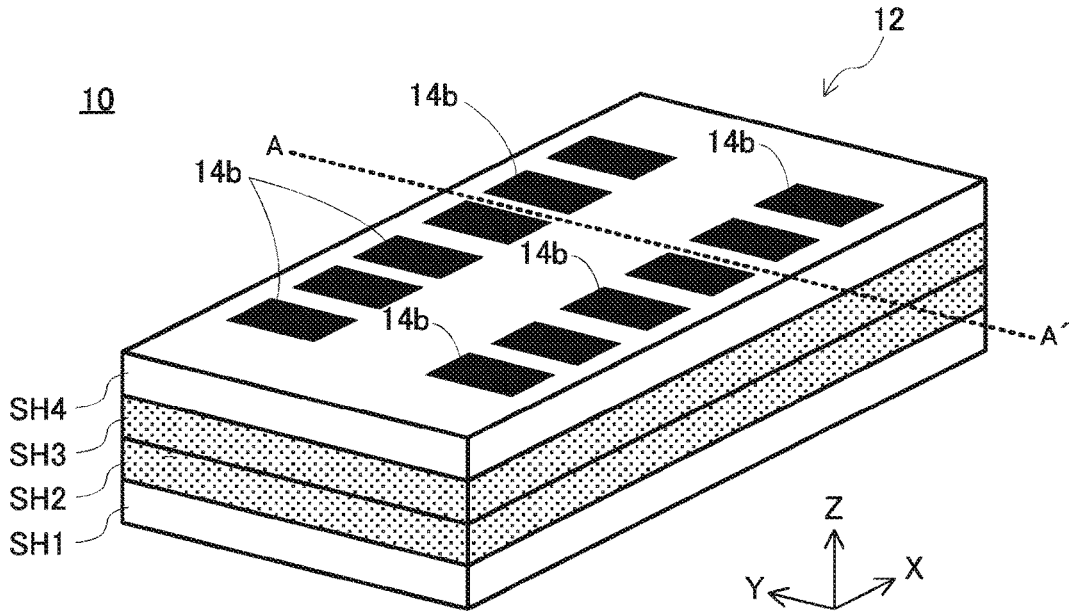
FIG. 4 is a perspective view showing appearance of the stack-type inductor element according to a preferred embodiment of the present invention.
Figure 5:
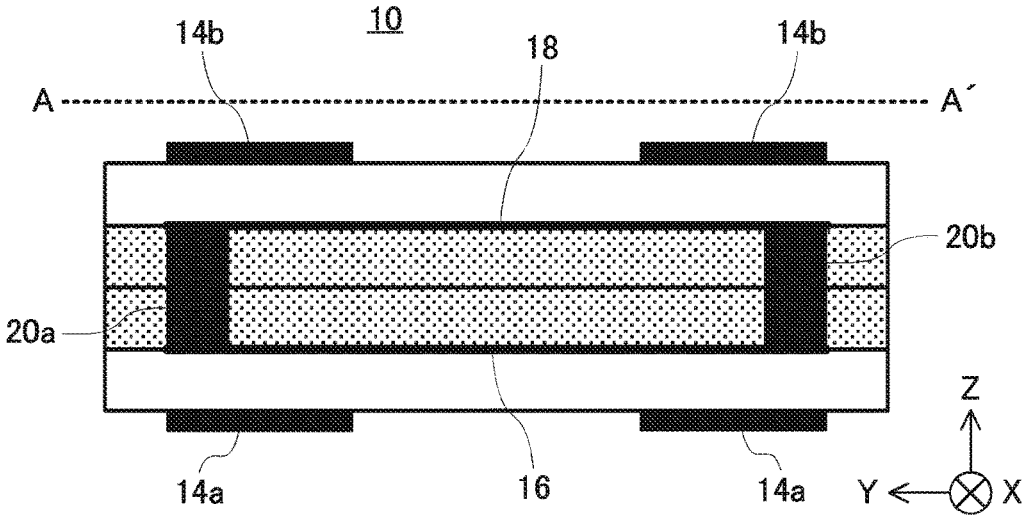
FIG. 5 is a cross-sectional view along A-A' of the stack-type inductor element shown in FIG. 4.
Figure 6A:
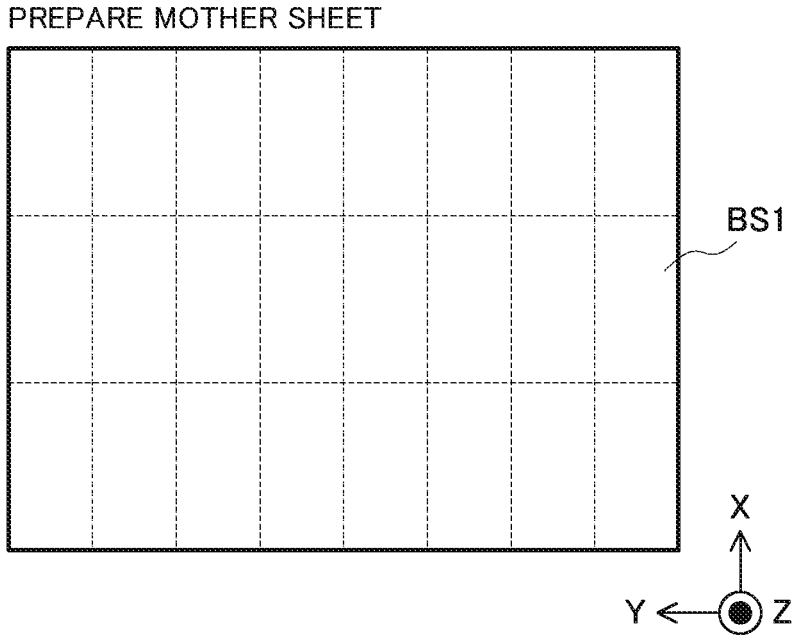
FIG. 6A is a process chart showing a portion of a process for manufacturing ceramic sheet SH1.
Figure 6B:
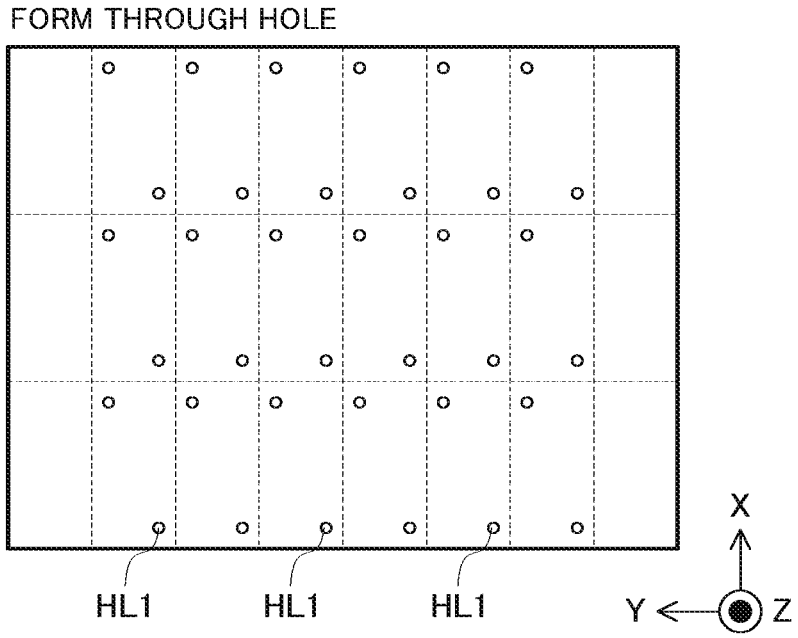
FIG. 6B is a process chart showing another portion of the process for manufacturing ceramic sheet SH1.

Stack 12, that is, stack-type inductor element 10, thus fabricated has appearance shown in FIG. 4. A cross-section along A-A' of this stack-type inductor element 10 has a structure shown in FIG. 5.

It is noted that ceramic sheets SH1 and SH4 preferably are made of a non-magnetite ferrite material (relative permeability: 1) and exhibit a value for coefficient of thermal expansion in a range from about 8.5 to about 9.0, for example. Ceramic sheets SH2 to SH3 preferably are made of a magnetite ferrite material (relative permeability: 100 to 120) and exhibit a value for coefficient of thermal expansion in a range from about 9.0 to about 10.0, for example. Pad electrodes 14*a* and 14*b*, linear conductors 16 and 18, and via hole conductors 20*a* to 20*b* and 22*a* to 22*b* preferably are made of a silver material and exhibit a coefficient of thermal expansion of about 20.

Ceramic sheet SH1 is fabricated in a manner shown in FIGS. 6A to 6B and FIGS. 7A to 7B. Initially, a ceramic green sheet made of a non-magnetic ferrite material is prepared as a mother sheet BS1 (see FIG. 6A). Here, a plurality of dashed lines extending in the direction of the X axis and the direction of the Y axis show cutting positions. Each of a plurality of rectangles defined by these dashed lines is defined as a "division unit".

Figure 7A:
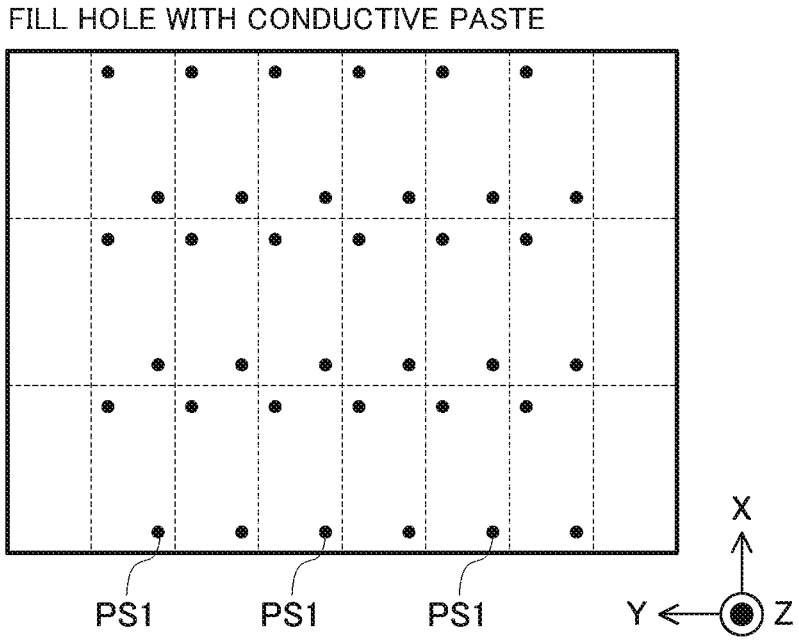
FIG. 7A is a process chart showing still another portion of the process for manufacturing ceramic sheet SH1.

Then, a plurality of through holes HL1 are formed in mother sheet BS1 in correspondence with the vicinity of an intersection of the dashed lines (see FIG. 6B), and through hole HL1 is filled with a conductive paste PS1 (see FIG. 7A). Conductive paste PS1 forms via hole conductor 22*a* or 22*b*. When filling with conductive paste PS1 is completed, a conductor pattern corresponding to linear conductors 16 is printed on an upper surface of mother sheet BS1 (see FIG. 7B).

Figure 8A:
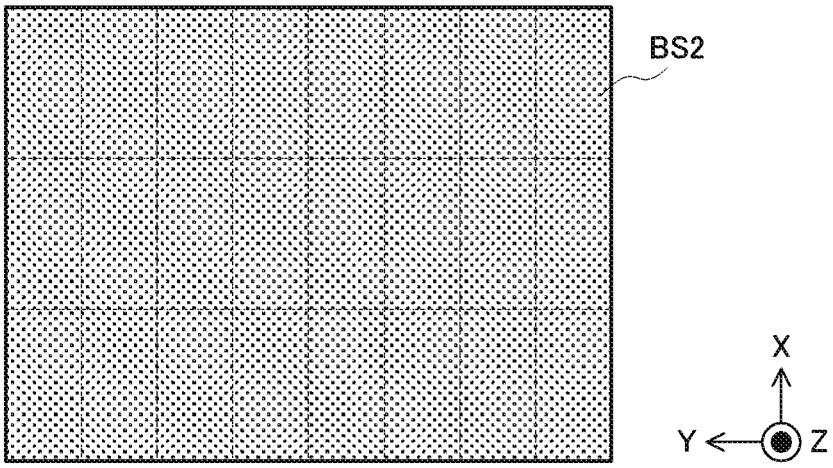
FIG. 8A is a process chart showing a portion of a process for manufacturing a ceramic sheet SH2.
Figure 8B:
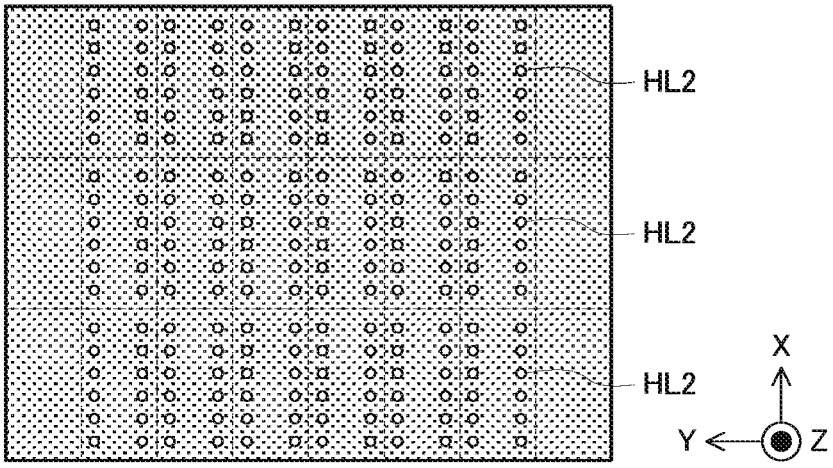
FIG. 8B is a process chart showing another portion of the process for manufacturing ceramic sheet SH2.
Figure 8C:
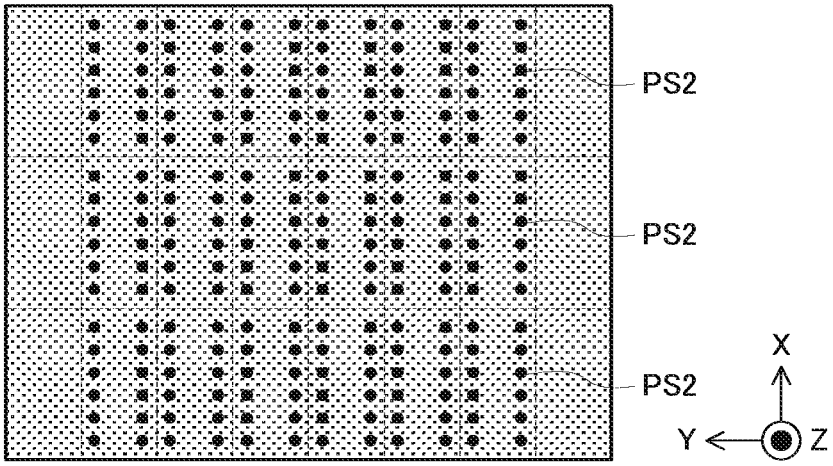
FIG. 8C is a process chart showing still another portion of the process for manufacturing ceramic sheet SH2.
Figure 9A:
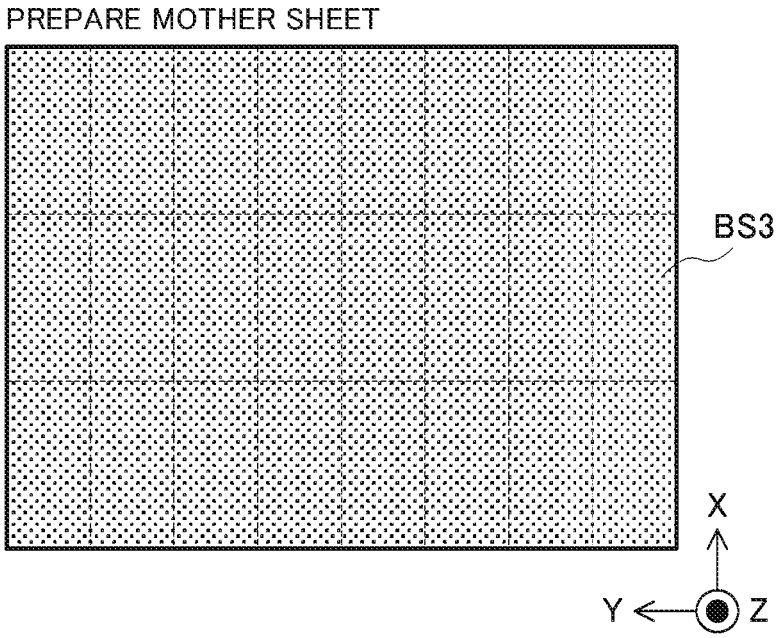
FIG. 9A is a process chart showing a portion of a process for manufacturing ceramic sheet SH3.
Figure 9B:
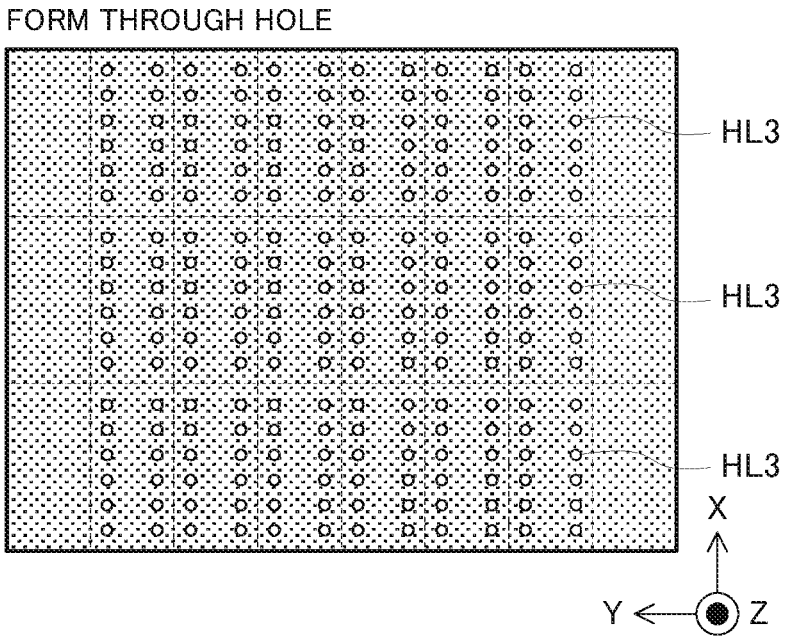
FIG. 9B is a process chart showing another portion of the process for manufacturing ceramic sheet SH3.

Ceramic sheet SH2 is fabricated in a manner shown in FIGS. 8A to 8C. Initially, a ceramic green sheet made of a magnetic ferrite material is prepared as a mother sheet BS2 (see FIG. 8A). Here, a plurality of dashed lines extending in the direction of the X axis and the direction of the Y axis show cutting positions. Then, a plurality of through holes HL2 are formed in mother sheet BS2 along the dashed lines extending in the direction of the X axis (see FIG. 8B), and through hole HL2 is filled with a conductive paste PS2 forming via hole conductor 20*a*, 20*b*, 22*a*, or 22*b* (see FIG. 8C).

Ceramic sheet SH3 is fabricated in a manner shown in FIGS. 9A to 9B and FIGS. 10A to 10B. Initially, a ceramic green sheet made of a magnetic ferrite material is prepared as a mother sheet BS3 (see FIG. 9A). Here, a plurality of dashed lines extending in the direction of the X axis and the direction of the Y axis show cutting positions.

Figure 10A:
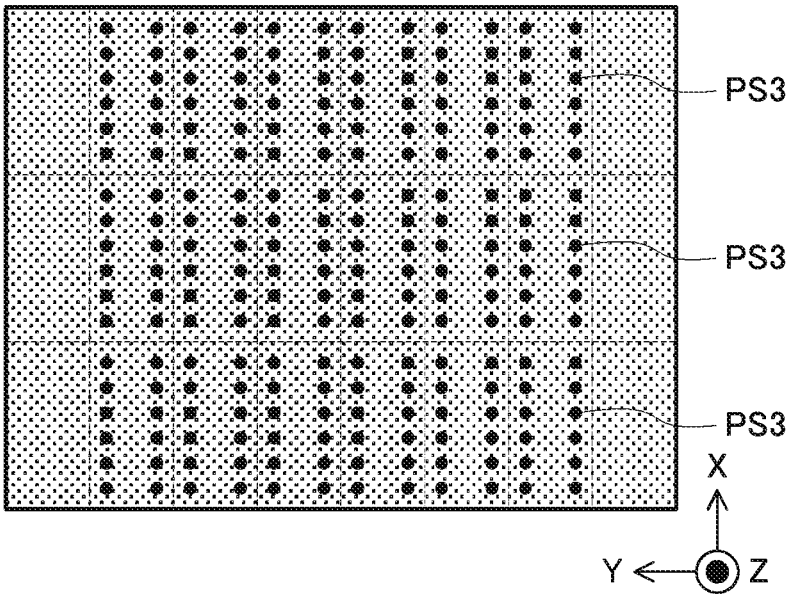
FIG. 10A is a process chart showing still another portion of the process for manufacturing ceramic sheet SH3.
Figure 10B:
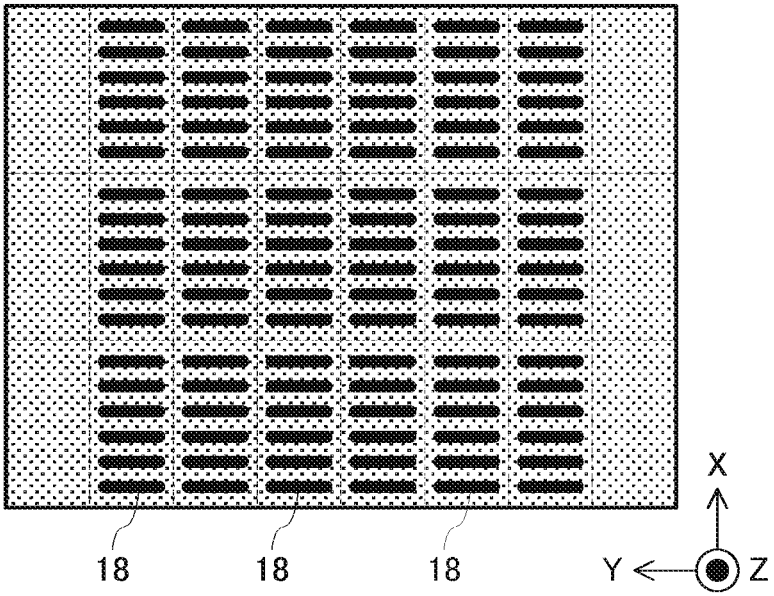
FIG. 10B is a process chart showing yet another portion of the process for manufacturing ceramic sheet SH3.

Then, a plurality of through holes HL3 are formed in mother sheet BS3 along the dashed lines extending in the direction of the X axis (see FIG. 9B), and through hole HL3 is filled with a conductive paste PS3 (see FIG. 10A). Conductive paste PS3 forms via hole conductor 20*a*, 20*b*, 22*a*, or 22*b*. When filling with conductive paste PS3 is completed, a conductor pattern corresponding to linear conductors 18 is printed on an upper surface of mother sheet BS3 (see FIG. 10B).

Figure 11A:
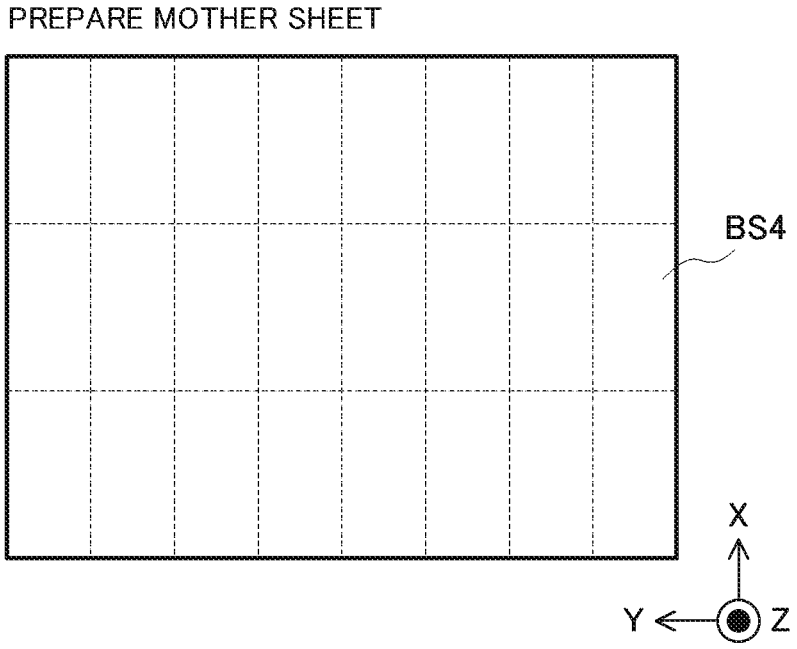
FIG. 11A is a process chart showing a portion of a process for manufacturing ceramic sheet SH4.
Figure 11B:
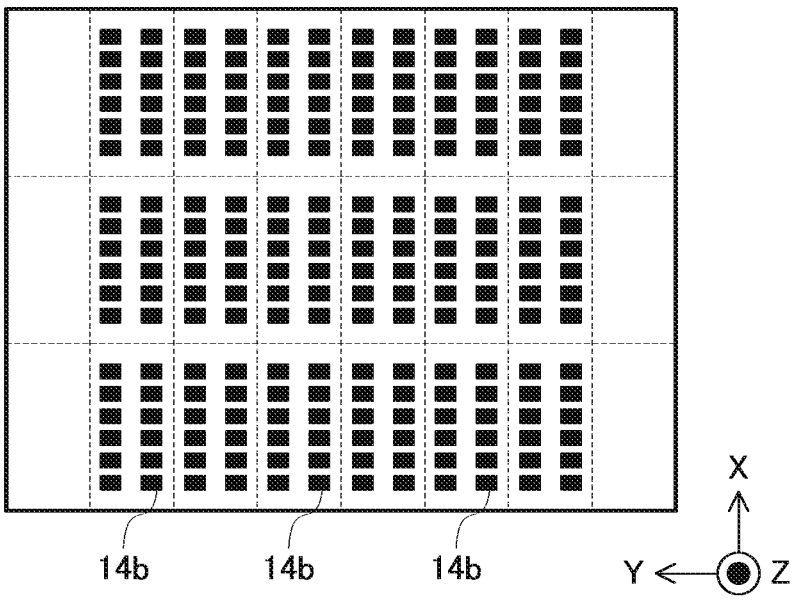
FIG. 11B is a process chart showing another portion of the process for manufacturing ceramic sheet SH4.

Ceramic sheet SH4 is fabricated in a manner shown in FIGS. 11A to 11B. Initially, a ceramic green sheet made of a non-magnetic ferrite material is prepared as a mother sheet BS4 (see FIG. 11A). Here, a plurality of dashed lines extending in the direction of the X axis and the direction of the Y axis show cutting positions. Then, a conductor pattern corresponding to pad electrodes 14*b* is printed on an upper surface of mother sheet BS4 (see FIG. 11B).

Figure 12:
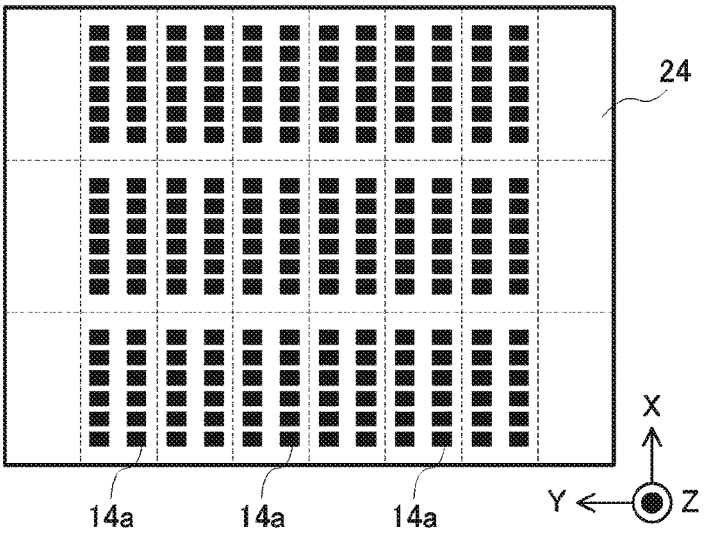
FIG. 12 is a plan view showing one example of a carrier film on which a pad electrode is printed.
Figure 13A:
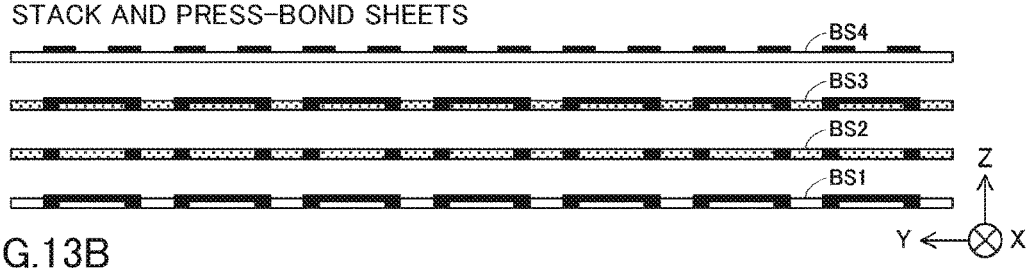
FIG. 13A is a process chart showing a portion of a process for manufacturing a stack-type inductor element.
Figure 13B:
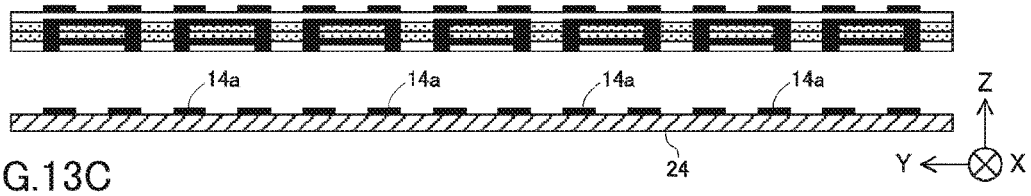
FIG. 13B is a process chart showing another portion of the process for manufacturing a stack-type inductor element.

The conductor pattern corresponding to pad electrodes 14*a* is printed on a carrier film 24 in a manner shown in FIG. 12. A size of a main surface of carrier film 24 is the same or substantially the same as a size of the main surface of mother sheets BS1 to BS4. A plurality of dashed lines extending in the direction of the X axis and the direction of the Y axis correspond to a plurality of dashed lines drawn on mother sheets BS1 to BS4. Mother sheets BS1 to BS4 created in the manner described above are stacked and press-bonded in this order (see FIG. 13A). Here, a position of stack of each sheet is adjusted such that dashed lines allocated to each sheet coincide when viewed in the direction of the Z axis. In succession, carrier film 24 shown in FIG. 12 is prepared (see FIG. 13B) and a conductor pattern formed on carrier film 24 is transferred to the lower surface of mother sheet BS1 (see FIG. 13C).

Figure 14A:
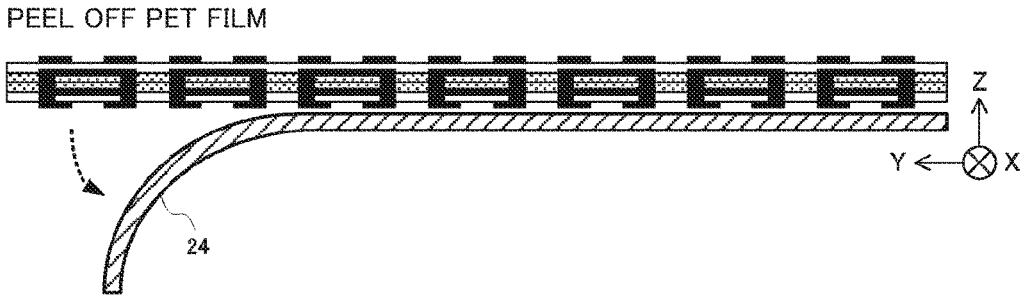
FIG. 14A is a process chart showing yet another portion of the process for manufacturing a stack-type inductor element.
Figure 14B:
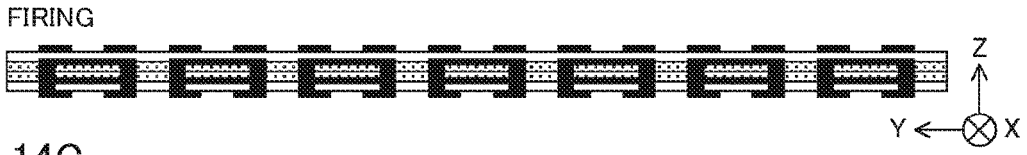
FIG. 14B is a process chart showing another portion of the process for manufacturing a stack-type inductor element.
Figure 14C:
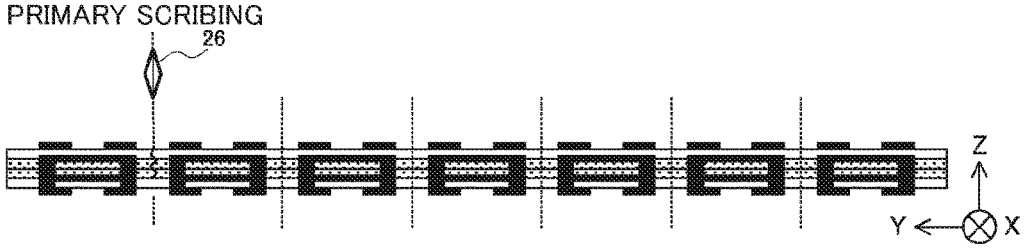
FIG. 14C is a process chart showing still another portion of the process for manufacturing a stack-type inductor element.
Figure 14D:
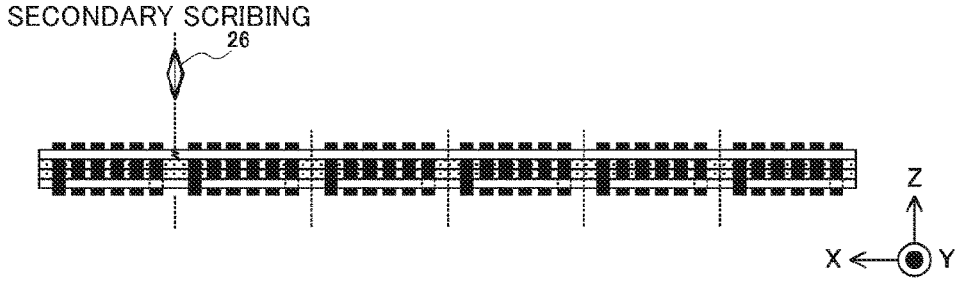
FIG. 14D is a process chart showing yet another portion of the process for manufacturing a stack-type inductor element.

As transfer of the conductor pattern is completed, carrier film 24 is peeled off (see FIG. 14A), and an unprocessed substrate assembly is fabricated. A thickness of the fabricated substrate assembly preferably is suppressed to about 0.6 mm or smaller, for example. The fabricated substrate assembly is fired (see FIG. 14B) and thereafter subjected to primary scribing and secondary scribing (see FIGS. 14C to 14D).

In primary scribing, a blade of a scriber 26 is applied along the dashed line extending in the direction of the X axis, and in secondary scribing, the blade of scriber 26 is applied along the dashed line extending in the direction of the Y axis. In any of primary scribing and secondary scribing, a groove is formed in an upper surface of the substrate assembly. It is noted that a groove formed in primary scribing reaches non-magnetic element layer 12*b*, whereas a groove formed in secondary scribing reaches only magnetic element layer 12*a*. This is a groove made by prior crack which was caused by adjusting a blade pressure at the time of application of the blade of scriber 26 and intentionally adjusting a depth. As scribing is completed, the substrate assembly is broken into division units, to obtain a plurality of stack-type inductor elements 10.

As can be seen from the description above, stack 12 includes magnetic element layer 12*a* and non-magnetic element layers 12*b* and 12*c* provided on respective opposing main surfaces thereof. Linear conductors 16 and 18 define a portion of an inductor having a longitudinal direction of stack 12 as an axis of winding and are provided on opposing main surfaces of magnetic element layer 12*a*. Pad electrodes 14*a* are provided on the upper surface of stack 12, and pad electrodes 14*b* are provided on the lower surface of stack 12 so as to be symmetric to pad electrodes 14*a*. Two different points of the inductor are electrically connected to two different pad electrodes 14*a* and 14*a*, respectively.

Stack-type inductor element 10 is manufactured by breaking a substrate assembly having a structure such that magnetic mother sheets BS2 and BS3 are sandwiched between non-magnetic mother sheets BS1 and BS4 into division units. The substrate assembly is fabricated in a manner below.

Figure 7B:
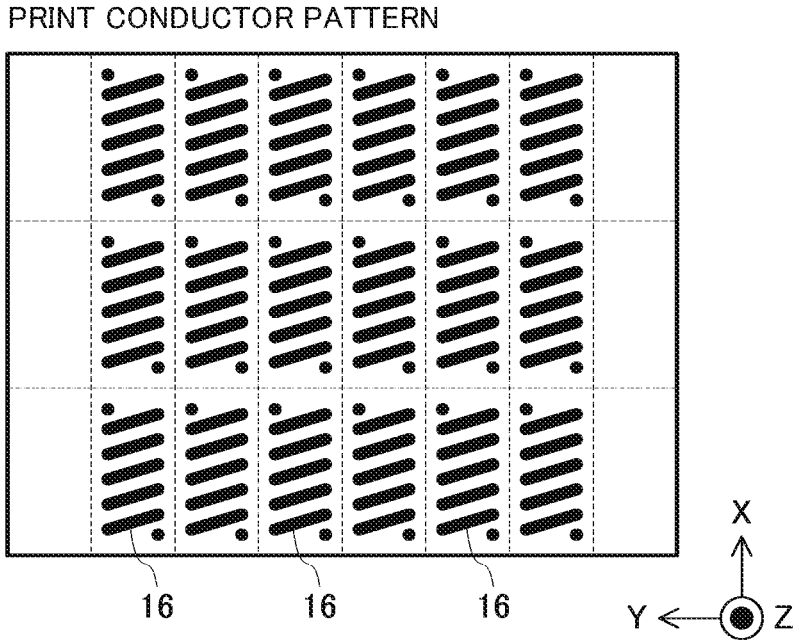
FIG. 7B is a process chart showing yet another portion of the process for manufacturing ceramic sheet SH1.

Initially, through holes HL1 extending in the direction of the Z axis are formed in mother sheet BS1 (see FIG. 6B), and a conductor pattern corresponding to linear conductors 16 is formed on the upper surface of mother sheet BS1 (see FIG. 7B). In addition, through holes HL2 extending in the direction of the Z axis are formed in mother sheet BS2 (see FIG. 8B), through holes HL3 extending in the direction of the Z axis are formed in mother sheet BS3 (see FIG. 9B), and a conductor pattern corresponding to linear conductors 18 is formed on the upper surface of mother sheet BS3 (see FIG. 10B).

Figure 13C:
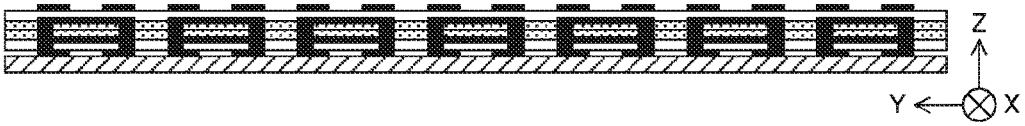
FIG. 13C is a process chart showing still another portion of the process for manufacturing a stack-type inductor element.

Carrier film 24 on which a plurality of pad electrodes 14*a* are printed is prepared on the lower surface of mother sheet BS1, and two pad electrodes 14*a* and 14*a* defining each division unit are connected to two points of linear conductors 16 through two corresponding through holes HL1 and HL1, respectively (see FIG. 13C). It is noted that pad electrodes 14*b* are formed on the upper surface of mother sheet BS4 so as to be symmetric to pad electrodes 14*a* (see FIG. 11B). The inductor is formed by spirally connecting linear conductors 16 and 18 for each division unit through holes HL2 and HL3 (see FIG. 13A).

The substrate assembly thus fabricated is subjected to primary scribing and secondary scribing after firing (see FIGS. 14B to 14D), and broken along grooves formed by such scribing.

In the fired substrate assembly, residual stress originating from a difference in coefficient of thermal expansion between a material forming pad electrodes 14*a* and 14*b* and linear conductors 16 and 18 and a material forming magnetic element layer 12*a* or non-magnetic element layers 12*b* and 12*c* is caused. It is noted that pad electrodes 14*a* and 14*b* formed on the opposing main surfaces of stack 12 are mirror symmetric to each other in this preferred embodiment. Therefore, warpage of the substrate assembly originating from residual stress is significantly reduced or prevented and stack-type inductor element 10 obtained by breakage is significantly smaller in thickness.

It is noted that decrease in thickness is suitable for a case that stack-type inductor element 10 is contained in an SIM card or a micro SIM card together with a secure IC for NFC (Near Field Communication), for example.

Since residual stress is generated, a breakage line runs in a direction of thickness of stack 12 so as to go around pad electrodes 14*a* and 14*b*. Thus, defective breakage is significantly decreased or prevented.

Furthermore, since no groove is present in a stage prior to firing, a magnetic element layer is not exposed and precipitation of plating onto a magnetic element layer is avoided. By making use of dummy pad electrode 14*a* (pad electrode 14*a* not connected to an inductor) to solder to mount stack-type inductor element 10 on a printed board, the number of points of contact between stack-type inductor element 10 and the printed board increases. Thus, fall strength or bending strength of stack-type inductor element 10 is enhanced.

Figure 15A:
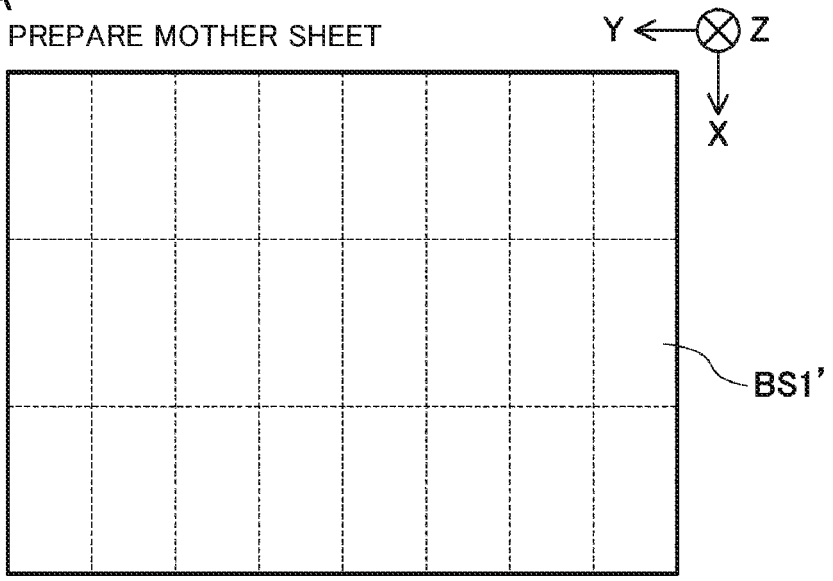
FIG. 15A is a process chart showing a portion of a process for manufacturing ceramic sheet SH1 according to another preferred embodiment of the present invention.
Figure 15B:
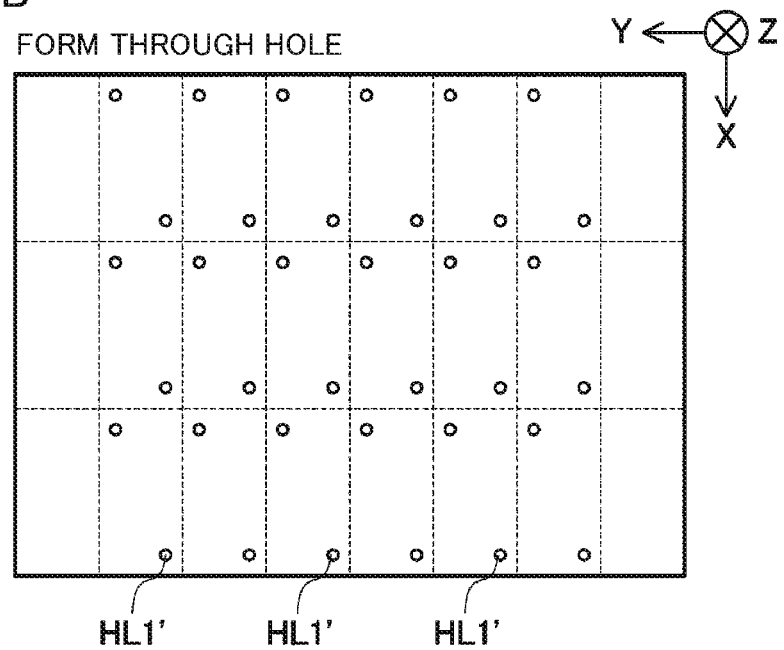
FIG. 15B is a process chart showing another portion of the process for manufacturing ceramic sheet SH1 according to another preferred embodiment of the present invention.

In succession, a method of manufacturing stack-type inductor element 10 in another preferred embodiment will be described. Ceramic sheet SH1 is fabricated in a manner shown in FIGS. 15A to 15B and FIGS. 16A to 16B. Initially, a ceramic green sheet made of a non-magnetic ferrite material is prepared as a mother sheet BS1' (see FIG. 15A). Here, a plurality of dashed lines extending in the direction of the X axis and the direction of the Y axis show cutting positions.

Figure 16A:
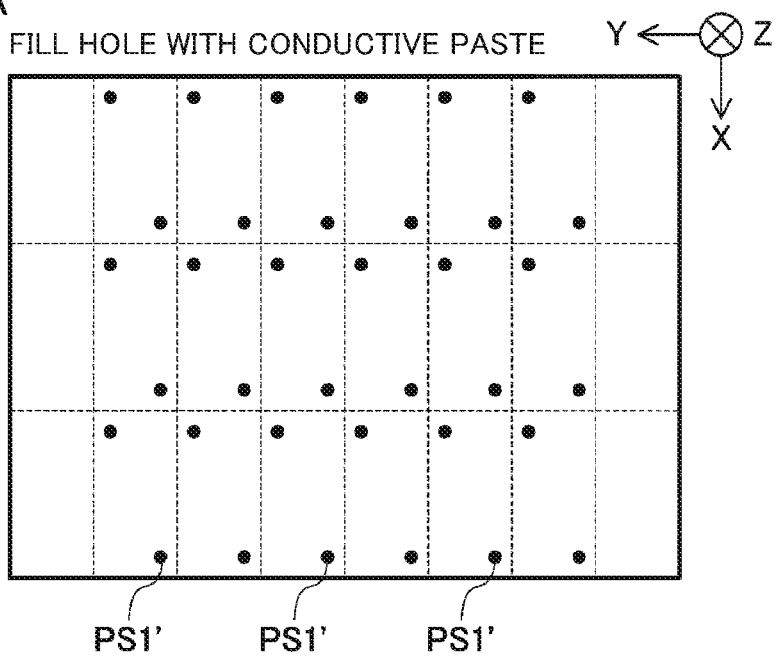
FIG. 16A is a process chart showing still another portion of the process for manufacturing ceramic sheet SH1 according to another preferred embodiment of the present invention.
Figure 16B:
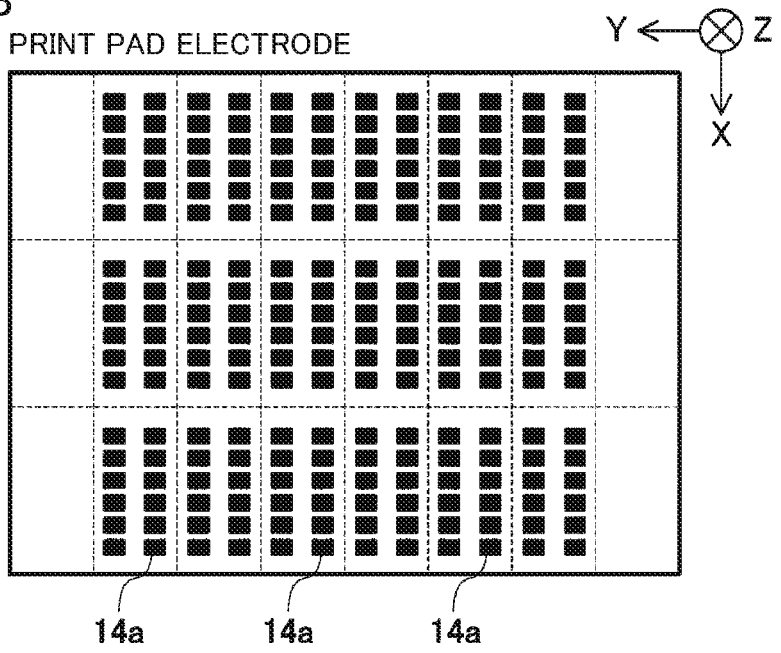
FIG. 16B is a process chart showing yet another portion of the process for manufacturing ceramic sheet SH1 according to another preferred embodiment of the present invention.
Figure 17A:
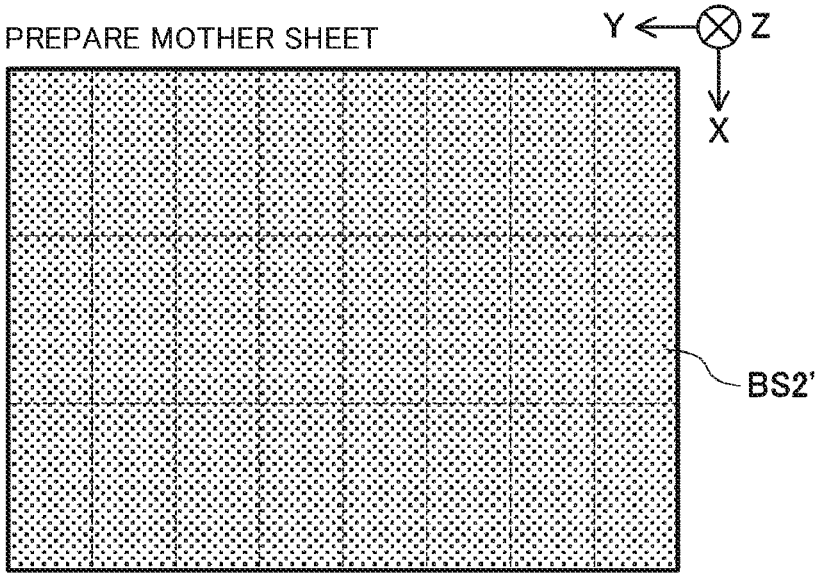
FIG. 17A is a process chart showing a portion of a process for manufacturing ceramic sheet SH2 according to another preferred embodiment of the present invention.
Figure 17B:
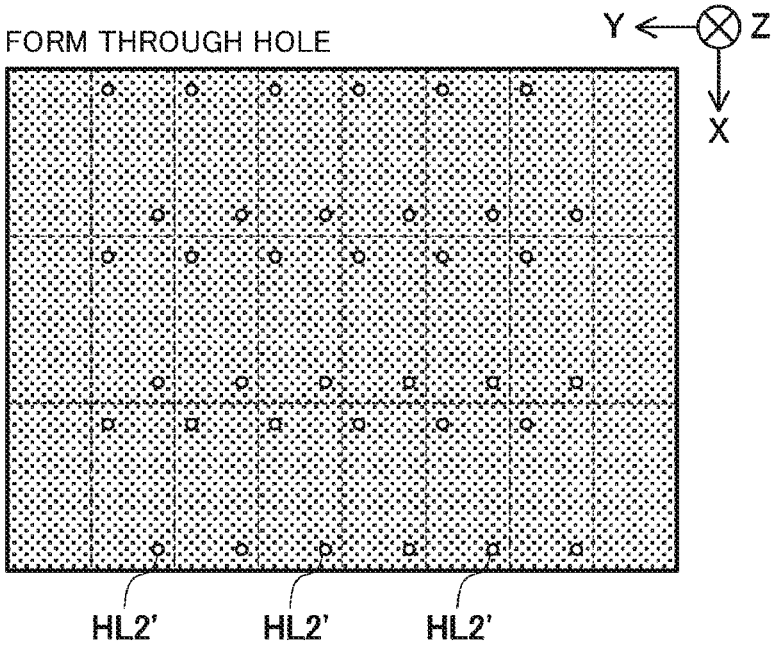
FIG. 17B is a process chart showing another portion of the process for manufacturing ceramic sheet SH2 according to another preferred embodiment of the present invention.
Figure 18A:
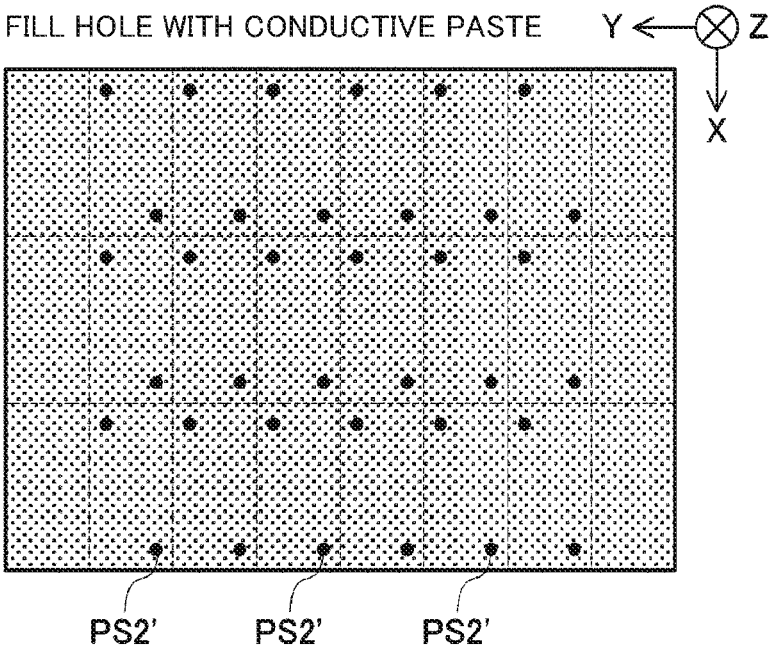
FIG. 18A is a process chart showing still another portion of the process for manufacturing ceramic sheet SH2 according to another preferred embodiment of the present invention.
Figure 18B:
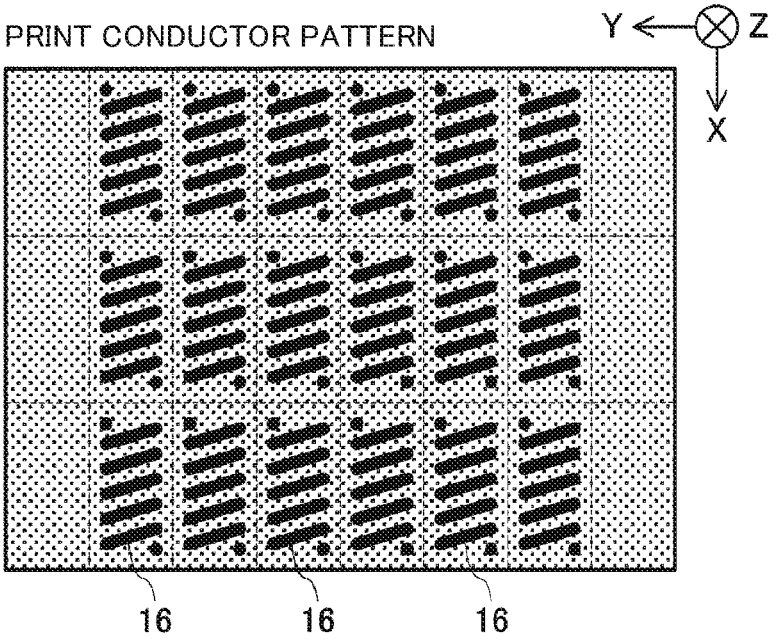
FIG. 18B is a process chart showing yet another portion of the process for manufacturing ceramic sheet SH2 according to another preferred embodiment of the present invention.
Figure 19A:
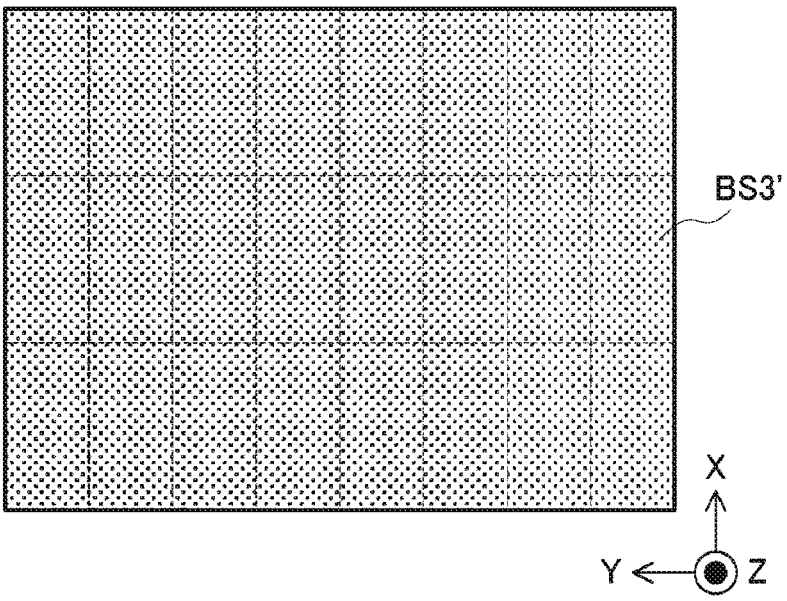
FIG. 19A is a process chart showing a portion of a process for manufacturing ceramic sheet SH3 according to another preferred embodiment of the present invention.
Figure 19B:
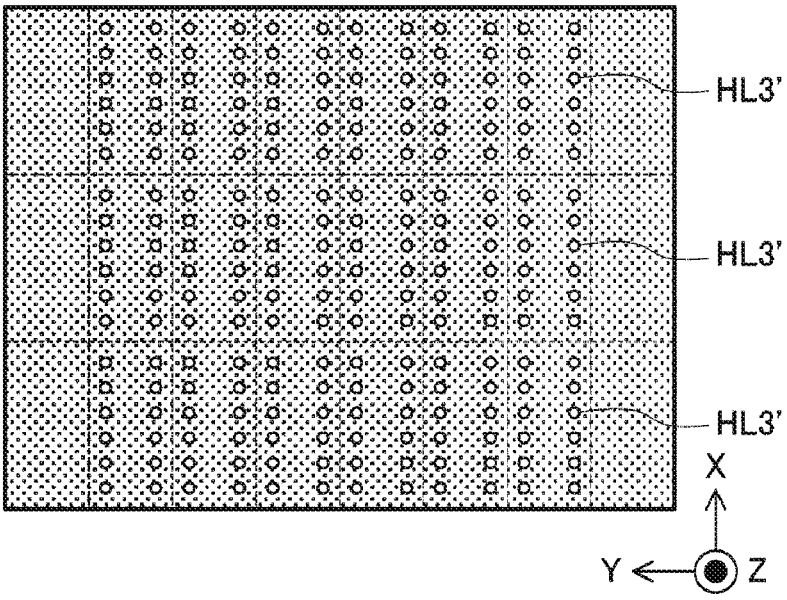
FIG. 19B is a process chart showing another portion of the process for manufacturing ceramic sheet SH3 according to another preferred embodiment of the present invention.

Then, a plurality of through holes HL1' are formed in mother sheet BS1' in correspondence with the vicinity of an intersection of the dashed lines (see FIG. 15B), and through hole HL1' is filled with a conductive paste PS1' (see FIG. 16A). Conductive paste PS1' forms via hole conductor 22*a* or 22*b*. When filling with conductive paste PS1' is completed, a conductor pattern corresponding to pad electrodes 14*a* is printed on a lower surface of mother sheet BS1' (see FIG. 16B).

Ceramic sheet SH2 is fabricated in a manner shown in FIGS. 17A to 17B and FIGS. 18A to 18B. Initially, a ceramic green sheet made of a magnetic ferrite material is prepared as a mother sheet BS2' (see FIG. 17A). Here, a plurality of dashed lines extending in the direction of the X axis and the direction of the Y axis show cutting positions. Then, a plurality of through holes HL2' are formed in mother sheet BS2' along a dashed line extending in the direction of the X axis (see FIG. 17B), and through hole HL2' is filled with a conductive paste PS2' forming via hole conductor 20*a*, 20*b*, 22*a*, or 22*b* (see FIG. 18A). When filling with conductive paste PS2' is completed, a conductor pattern corresponding to linear conductors 16 is printed on a lower surface of mother sheet BS2' (see FIG. 18B).

Ceramic sheet SH3 is fabricated in a manner shown in FIGS. 19A to 19B and FIGS. 20A to 20B. Initially, a ceramic green sheet made of a magnetic ferrite material is prepared as a mother sheet BS3' (see FIG. 19A). Here, a plurality of dashed lines extending in the direction of the X axis and the direction of the Y axis show cutting positions.

Figure 20A:
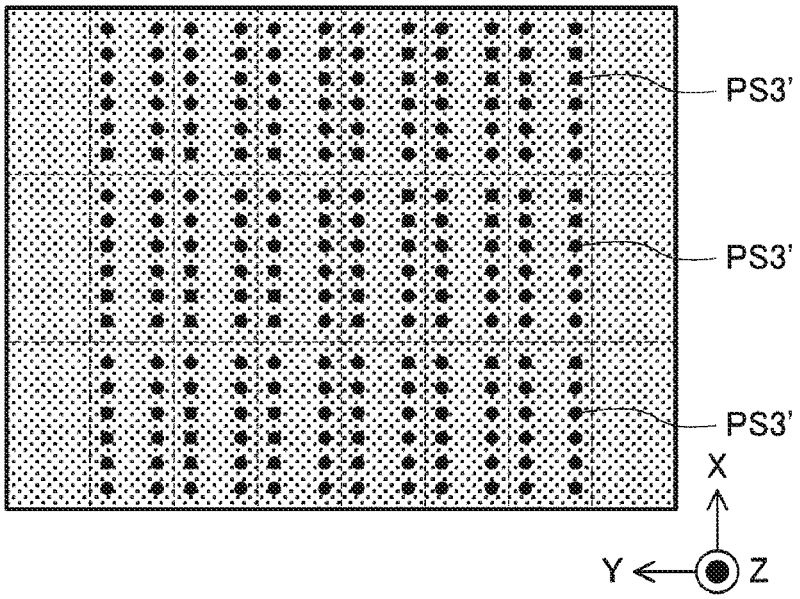
FIG. 20A is a process chart showing still another portion of the process for manufacturing ceramic sheet SH3 according to another preferred embodiment of the present invention.
Figure 20B:
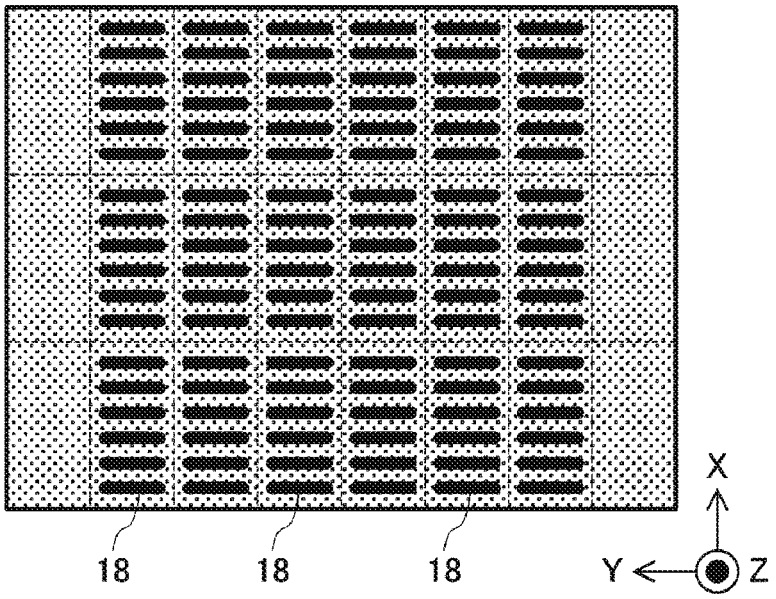
FIG. 20B is a process chart showing yet another portion of the process for manufacturing ceramic sheet SH3 according to another preferred embodiment of the present invention.

Then, a plurality of through holes HL3' are formed in mother sheet BS3' along the dashed line extending in the direction of the X axis (see FIG. 19B), and through hole HL3' is filled with a conductive paste PS3' (see FIG. 20A). Conductive paste PS3' forms via hole conductor 20*a*, 20*b*, 22*a*, or 22*b*. When filling with conductive paste PS3' is completed, a conductor pattern corresponding to linear conductors 18 is printed on an upper surface of mother sheet BS3' (see FIG. 20B).

Figure 21A:
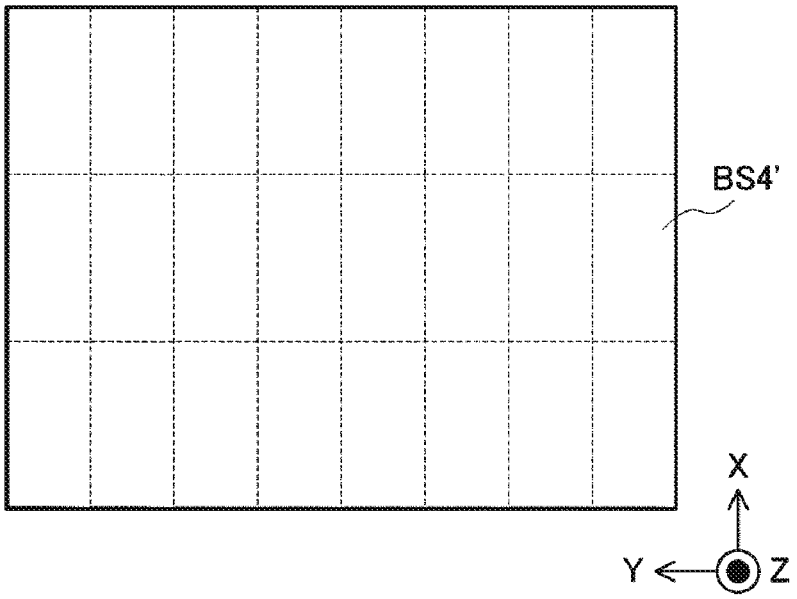
FIG. 21A is a process chart showing a portion of a process for manufacturing ceramic sheet SH4 according to another preferred embodiment of the present invention.
Figure 21B:
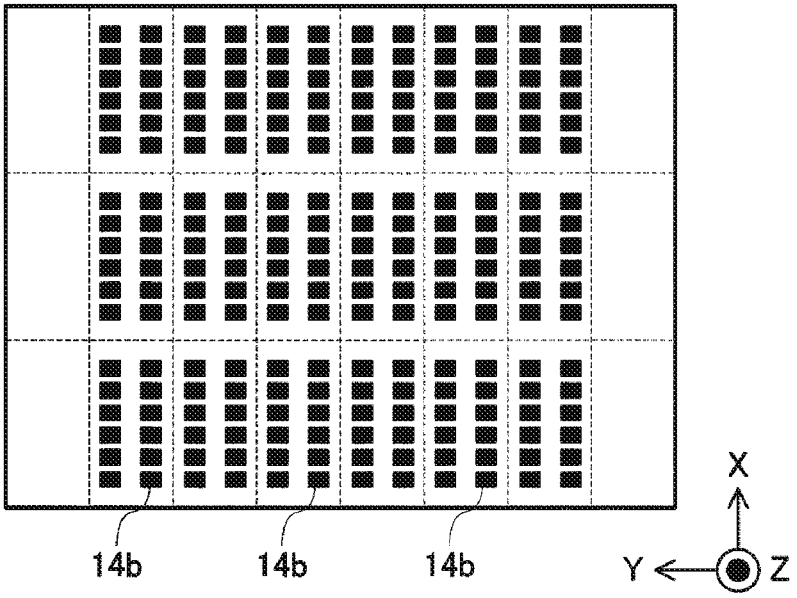
FIG. 21B is a process chart showing another portion of the process for manufacturing ceramic sheet SH4 according to another preferred embodiment of the present invention.

Ceramic sheet SH4 is fabricated in a manner shown in FIGS. 21A to 21B. Initially, a ceramic green sheet made of a non-magnetic ferrite material is prepared as a mother sheet BS4' (see FIG. 21A). Here, a plurality of dashed lines extending in the direction of the X axis and the direction of the Y axis show cutting positions. Then, a conductor pattern corresponding to pad electrodes 14*b* is printed on an upper surface of mother sheet BS4' (see FIG. 21B).

Figure 22A:
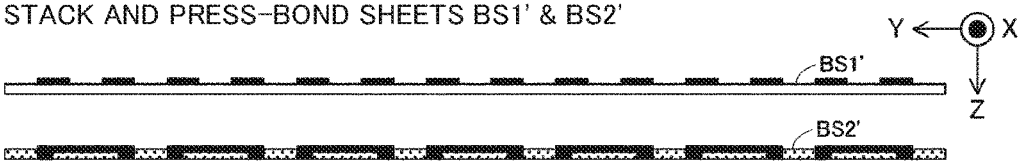
FIG. 22A is a process chart showing a portion of a process for manufacturing a stack-type inductor element according to another preferred embodiment of the present invention.

Mother sheets BS1' and BS2' are stacked and press-bonded in such a position that a lower surface of mother sheet BS2' faces the upper surface of mother sheet BS1' (see FIG. 22A). Here, a position of stack of each sheet is adjusted such that dashed lines allocated to each sheet coincide when viewed in the direction of the Z axis.

Figure 22B:
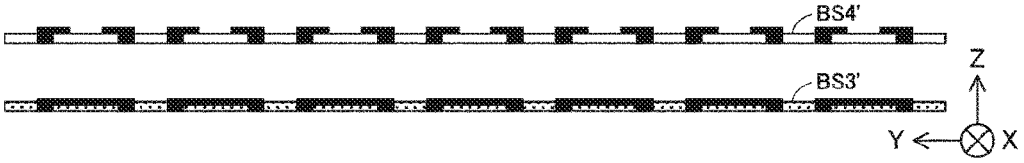
FIG. 22B is a process chart showing another portion of the process for manufacturing a stack-type inductor element according to another preferred embodiment of the present invention.

Similarly, mother sheets BS3' and BS4' are stacked and press-bonded in such a position that the upper surface of mother sheet BS3' faces a lower surface of mother sheet BS4' (see FIG. 22B). Here again, a position of stack of each sheet is adjusted such that dashed lines allocated to each sheet coincide when viewed in the direction of the Z axis.

Figure 22C:
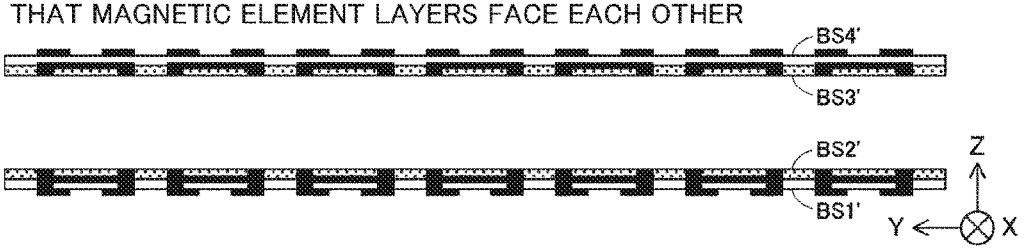
FIG. 22C is a process chart showing still another portion of the process for manufacturing a stack-type inductor element according to another preferred embodiment of the present invention.
Figure 23A:
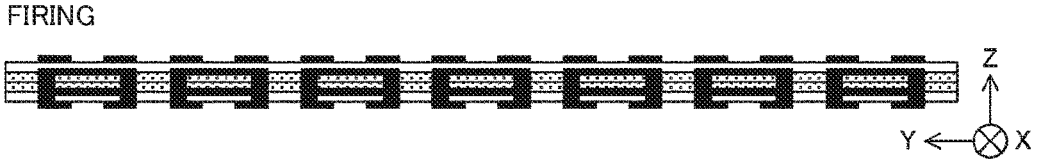
FIG. 23A is a process chart showing yet another portion of the process for manufacturing a stack-type inductor element according to another preferred embodiment of the present invention.
Figure 23B:
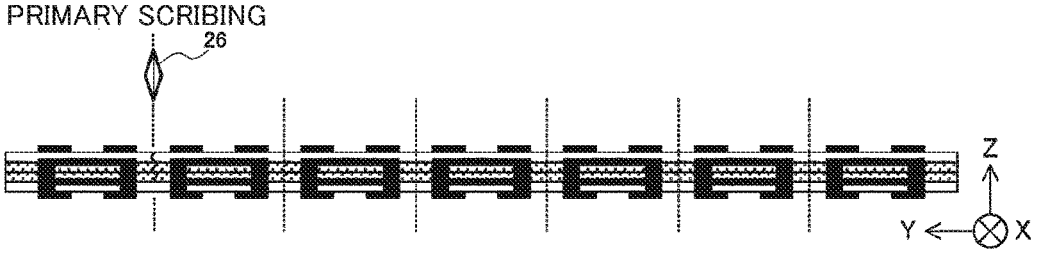
FIG. 23B is a process chart showing another portion of the process for manufacturing a stack-type inductor element according to another preferred embodiment of the present invention.
Figure 23C:
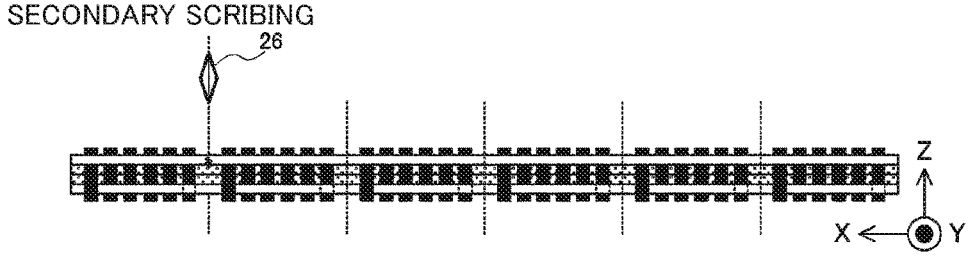
FIG. 23C is a process chart showing still another portion of the process for manufacturing a stack-type inductor element according to another preferred embodiment of the present invention.

In succession, a vertical direction of the stack based on mother sheets BS1' and BS2' is inverted, and the stack based on mother sheets BS3' and BS4' is additionally stacked and press-bonded (see FIG. 22C). Here, a position of stack is adjusted such that the lower surface of mother sheet BS3' faces the upper surface of mother sheet BS2' and dashed lines allocated to each sheet coincide when viewed in the direction of the Z axis. Thus, an unprocessed substrate assembly of which thickness is reduced to about 0.6 mm or smaller, for example, is fabricated. The fabricated substrate assembly is fired (see FIG. 23A), and thereafter subjected to primary scribing and secondary scribing (see FIGS. 23B to 23C).

In primary scribing, a blade of scriber 26 is applied along the dashed line extending in the direction of the X axis, and in secondary scribing, the blade of scriber 26 is applied along the dashed line extending in the direction of the Y axis. In any of primary scribing and secondary scribing, a groove is formed in an upper surface of the substrate assembly. It is noted that a groove formed in primary scribing reaches non-magnetic element layer 12*b*, whereas a groove formed in secondary scribing reaches only magnetic element layer 12*a*. As scribing is completed, the substrate assembly is broken into division units to obtain a plurality of stack-type inductor elements 10.

In this preferred embodiment as well, in the fired substrate assembly, residual stress originating from a difference in coefficient of thermal expansion between a material forming pad electrodes 14*a* and 14*b* and linear conductors 16 and 18 and a material forming magnetic element layer 12*a* or non-magnetic element layers 12*b* and 12*c* is caused. It is noted that pad electrodes 14*a* and 14*b* provided on the opposing main surfaces of stack 12 are mirror symmetric to each other and therefore warpage of the substrate assembly originating from residual stress is significantly decreased or prevented and stack-type inductor element 10 obtained by breakage is smaller in thickness.

It is noted that linear conductor 16 extends obliquely to the Y axis, whereas linear conductor 18 extends in the direction of the Y axis in the preferred embodiment described above. So long as linear conductors 16 and 18 are connected like a coil by via hole conductors 20*a* and 20*b*, however, a direction of extension of linear conductors 16 and 18 may be different from that in this preferred embodiment.

In addition, in the preferred embodiment described above, a conductor pattern corresponding to linear conductors 18 preferably is printed on the upper surface of mother sheet BS3 or BS3'. The conductor pattern corresponding to linear conductor 18, however, may be printed on the lower surface of mother sheet BS4 or BS4'.

Moreover, in this preferred embodiment, ceramic sheets SH2 and SH3 are stacked to define magnetic element layer 12*a*. Magnetic element layer 12*a* may be formed, however, by stacking a plurality of ceramic sheets corresponding to magnetic element layer ceramic sheet SH2 and ceramic sheet SH3.

Figure 24:
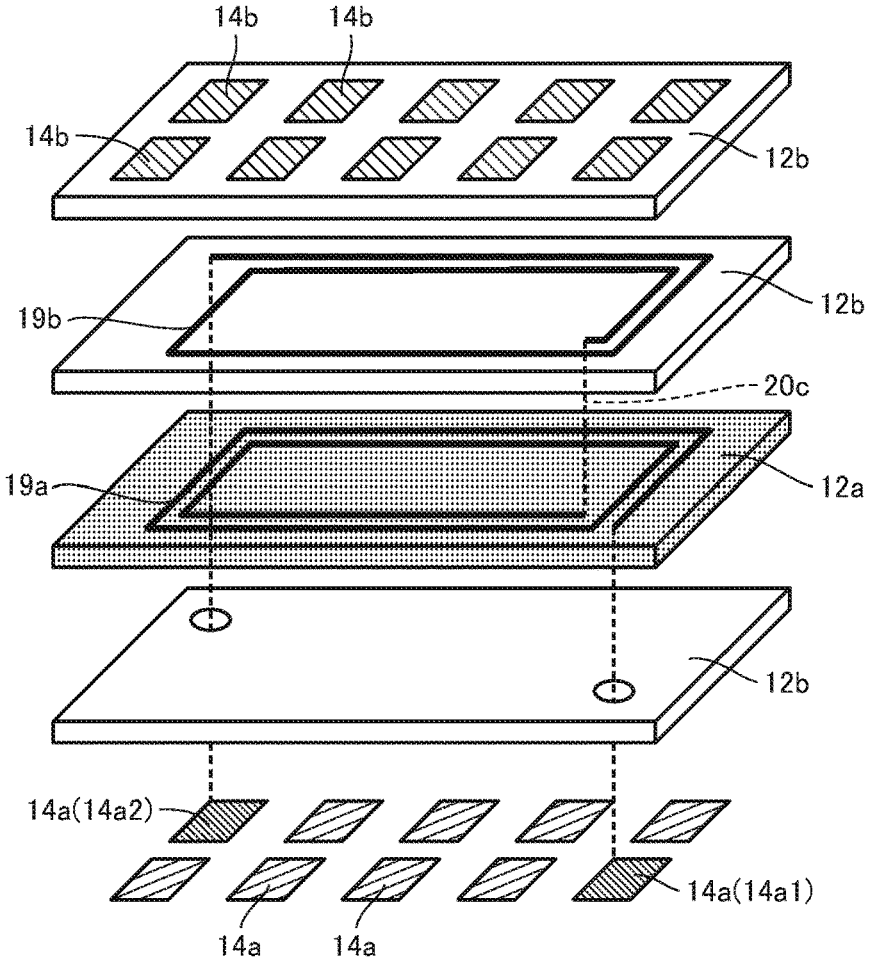
FIG. 24 is an exploded view showing a disassembled state of a stack-type inductor element according to yet another preferred embodiment of the present invention.

In the preferred embodiment of the stack-type inductor element shown in FIGS. 1 to 5, in forming a coil conductor pattern by stacking magnetic element layers, an axis of winding of this coil conductor pattern is parallel or substantially parallel to a main surface of the magnetic element layer, however, this is merely one example and it may be perpendicular or substantially perpendicular to the main surface of the magnetic element layer, for example, as shown in FIG. 24. In an example shown in FIG. 24, the axis of winding extends in a vertical direction in the figure.

In the example shown in FIG. 24, non-magnetic element layer 12*b*, magnetic element layer 12*a*, non-magnetic element layer 12*b*, and non-magnetic element layer 12*b* are successively stacked from below. The stack as a whole preferably defines a parallelepiped. Two rows of pad electrodes 14*a* are arranged on a lower surface of non-magnetic element layer 12*b* located lowest in FIG. 24. In FIG. 24, for the sake of convenience of illustration, a manner of alignment of pad electrodes on the lower surface of non-magnetic element layer 12*b* located lowest is shown as being projected further below. A condition for alignment of these pad electrodes 14*a* is the same as described with reference to FIG. 3A. Though six pad electrodes 14*a* are aligned along a longitudinal direction in FIG. 3A, the number of pad electrodes 14*a* aligned along the longitudinal direction is five in the example shown in FIG. 24. The number of pad electrodes 14*a* aligned in the longitudinal direction is shown merely by way of example, and the number is not limited thereto.

A helical in-plane conductor 19*a* is provided on an upper surface of magnetic element layer 12*a*. On an upper surface of non-magnetic element layer 12*b* adjacent to an upper side of magnetic element layer 12*a*, a helical in-plane conductor 19*b* is provided. It is noted that, when viewed in a direction of stack, in-plane conductor 19*a* and in-plane conductor 19*b* do not completely coincide with each other and they are different in position occupied. When viewed in the direction of stack, they satisfy such positional relation that one end of in-plane conductor 19*a* and one end of in-plane conductor 19*b* coincide with each other. On an upper surface of non-magnetic element layer 12*b* located highest in FIG. 24, two rows of pad electrodes 14*b* are arranged. A condition for alignment of these pad electrodes 14*b* is the same as described with reference to FIG. 3B. The number of pad electrodes 14*b* aligned in the longitudinal direction is shown merely by way of example and the number is not limited thereto.

One end of in-plane conductor 19*a* is electrically connected to one end of in-plane conductor 19*b* through a via hole conductor 20*c* provided to pass through non-magnetic element layer 12*b* adjacent to the upper side of magnetic element layer 12*a*. The other end of in-plane conductor 19*a* is electrically connected through another via hole conductor to a pad electrode 14*a*1 which is one of pad electrodes 14*a* provided on a lowermost surface. The other end of in-plane conductor 19*b* is electrically connected through yet another via hole conductor to a pad electrode 14*a*2 which is another one of pad electrodes 14*a* provided on the lowermost surface.

Consequently, in-plane conductor 19*a*, via hole conductor 20*c*, and in-plane conductor 19*b* are connected like a coil, so that a coil conductor having the axis of winding in the direction of stack is provided. The stack, that is, the stack-type inductor element, thus fabricated is substantially the same in appearance as shown in FIG. 4. It is noted that, in FIG. 4, two layers of ceramic sheets SH2 and SH3 were magnetic elements and hence a portion hatched with dots, which represents a magnetic element, appeared as a thickness of two layers on a side surface of the stack also in the perspective view. In FIG. 24, however, single magnetic element layer 12*a* is provided, and hence a thickness of a magnetic element portion which appears on the side surface of the stack is different.

It is noted that an alignment pattern of pad electrodes provided on the lowermost surface and the uppermost surface of the stack is not limited to those as described so far. For example, the alignment pattern may be as shown in FIGS. 25 to 29. In FIGS. 25 to 29, for the sake of convenience of illustration, a manner of alignment of pad electrodes on the lower surface of non-magnetic element layer 12*b* located lowest is shown as being projected further below.

Figure 25:
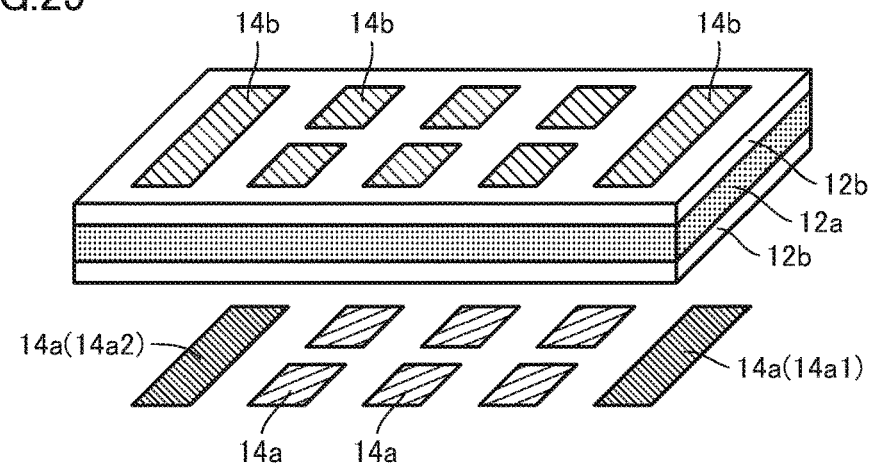
FIG. 25 is an explanatory diagram of a first example of alignment of pad electrodes provided on a lowermost surface and an uppermost surface of the stack-type inductor element.

As shown in FIG. 25, a plurality of pad electrodes 14*b* arranged on the uppermost surface of the stack may be of two mixed types of large and small. At opposing ends in the longitudinal direction, pad electrodes 14*b* each in a strip shape which extend in a direction of a short side of the stack are arranged, and pad electrodes 14*b* substantially in a square shape are arranged in an intermediate portion lying between two pad electrodes 14*b* each in a strip shape. This is also the case with a plurality of pad electrodes 14*a* arranged on the lowermost surface of the stack.

In the example shown in FIG. 25, a plurality of pad electrodes 14*b* arranged on the uppermost surface of the stack are all electrically open regardless of a size. Two pad electrodes 14*a*1 and 14*a*2 each in a strip shape, which are located at the respective opposing ends in the longitudinal direction of the plurality of pad electrodes 14*a* arranged on the lowermost surface, are electrically connected to a coil conductor provided in the inside of the stack, and pad electrodes 14*a* other than those are electrically open.

Figure 26:
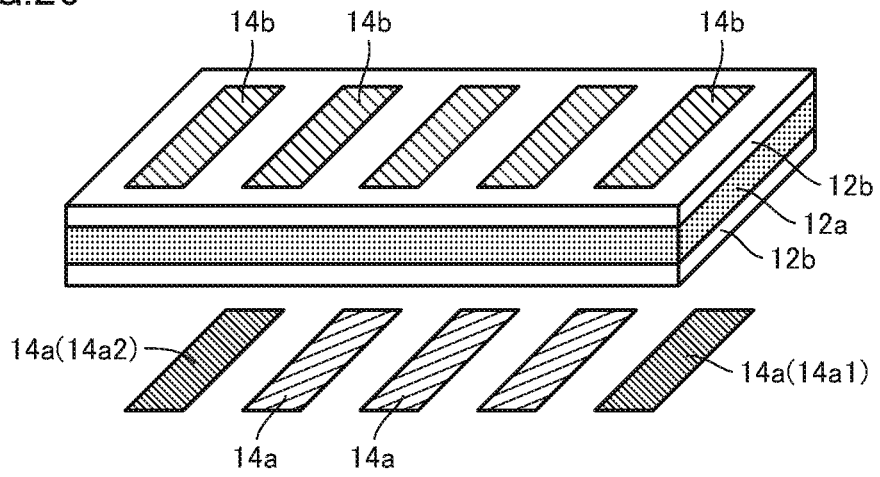
FIG. 26 is an explanatory diagram of a second example of alignment of the pad electrodes provided on the lowermost surface and the uppermost surface of the stack-type inductor element.

As shown in FIG. 26, all of the plurality of pad electrodes 14*b* arranged on the uppermost surface of the stack preferably have a strip shape extending in the direction of the short side of the stack. This is also the case with the plurality of pad electrodes 14*a* arranged on the lowermost surface of the stack.

In the example shown in FIG. 26, the plurality of pad electrodes 14*b* arranged on the uppermost surface of the stack are all electrically open. Two pad electrodes 14*a*1 and 14*a*2 each in a strip shape, which are located at the respective opposing ends in the longitudinal direction of the plurality of pad electrodes 14*a* arranged on the lowermost surface, are electrically connected to the coil conductor provided inside of the stack, and pad electrodes 14 other than those are electrically open.

Figure 27:
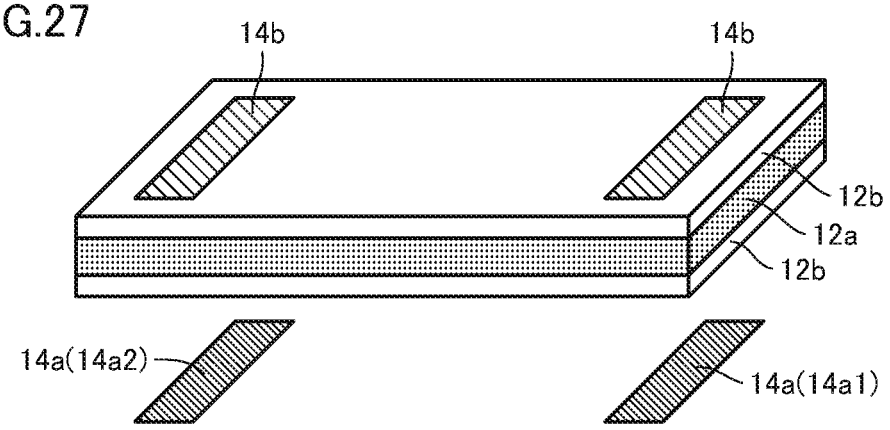
FIG. 27 is an explanatory diagram of a third example of alignment of the pad electrodes provided on the lowermost surface and the uppermost surface of the stack-type inductor element.

As shown in FIG. 27, the number of pad electrodes 14*b* arranged on the uppermost surface of the stack may be set to two and only one pad electrode 14*b* may be arranged at each end in the longitudinal direction. Though pad electrode 14*b* preferably is strip shaped in this example, this is merely by way of example and the shape is not limited to a strip shape. This is also the case with the plurality of pad electrodes 14*a* arranged on the lowermost surface of the stack.

In the example shown in FIG. 27, no pad electrode is arranged in a central portion on the uppermost surface and the lowermost surface of the stack. Such a construction is also acceptable. In the example shown in FIG. 27, two pad electrodes 14*b* arranged on the uppermost surface of the stack are each electrically open. Two pad electrodes 14*a*1 and 14*a*2 each in a strip shape arranged on the lowermost surface are electrically connected to the coil conductor provided inside of the stack.

Figure 28:
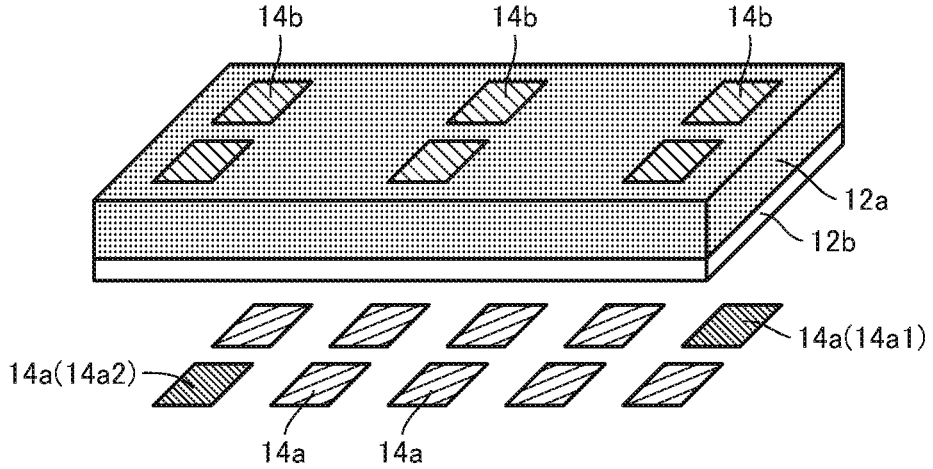
FIG. 28 is an explanatory diagram of a fourth example of alignment of the pad electrodes provided on the lowermost surface and the uppermost surface of the stack-type inductor element.

As shown in FIG. 28, alignment or the number of pad electrodes may be different between the lowermost surface and the uppermost surface of the stack. In the example shown in FIG. 28, on the lowermost surface, ten pad electrodes 14*a* in total are arranged in matrix of 2×5, whereas on the uppermost surface, six pad electrodes 14*b* in total are arranged in matrix of 2×3. The number may thus be different.

Figure 29:
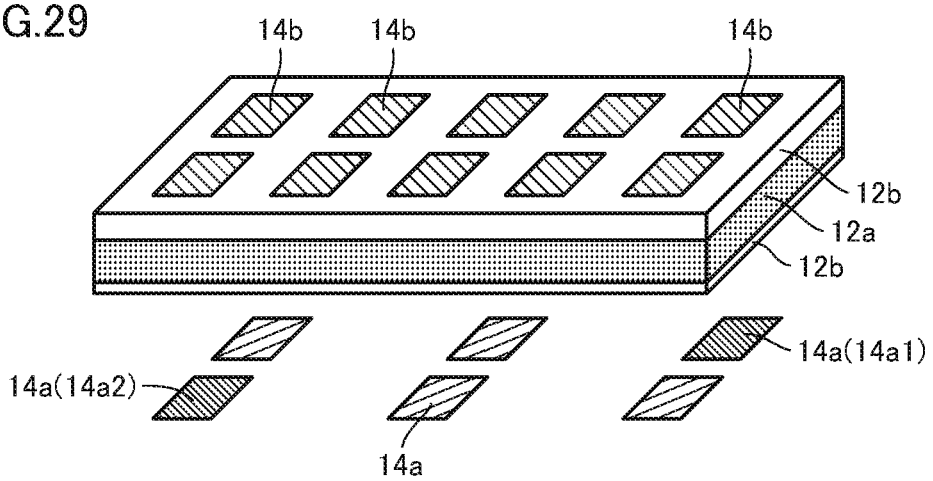
FIG. 29 is an explanatory diagram of a fifth example of alignment of the pad electrodes provided on the lowermost surface and the uppermost surface of the stack-type inductor element.

As shown in FIG. 29, the number of pad electrodes may be smaller in the lowermost surface than in the uppermost surface. In the example shown in FIG. 29, on the lowermost surface, six pad electrodes 14*a* in total are arranged in matrix of 2×3, whereas on the uppermost surface, ten pad electrodes 14*b* in total are arranged in matrix of 2×5.

In the examples shown in FIGS. 28 and 29, the plurality of pad electrodes 14*b* arranged on the uppermost surface of the stack are all electrically open. Two pad electrodes 14*a*1 and 14*a*2 of the plurality of pad electrodes 14*a* arranged on the lowermost surface are electrically connected to the coil conductor provided inside of the stack, and pad electrodes 14*a* other than those are electrically open.

In FIGS. 28 and 29, how magnetic element layer 12*a* and non-magnetic element layer 12*b* appear on the side surface is different from that in FIGS. 25 to 27. In accordance with change in construction of pad electrodes on the uppermost surface or the lowermost surface of the stack, how they are aligned or a ratio of thickness may be varied as appropriate between the magnetic element layer and the non-magnetic element layer in a thickness of the stack as a whole.

The number of magnetic element layers 12*a* and non-magnetic element layers 12*b* included in the stack shown in the drawings by way of example only and limitation thereto is not intended in each preferred embodiment described so far. In addition, a non-magnetic element layer does not necessarily have to be provided and all layers in the stack may be defined by magnetic element layers.

As already described, the stack described so far preferably is a stack-type inductor element. Such a stack-type inductor element can be used, for example, as an antenna element for wireless communication. Exemplary usage thereof will be described below.

Figure 30:
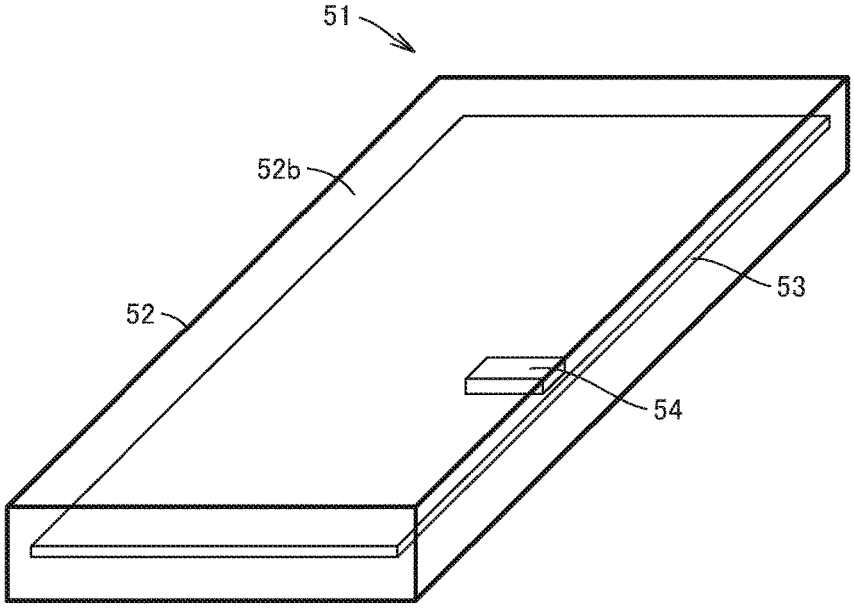
FIG. 30 is a perspective transparent view of a communication device.
Figure 31:
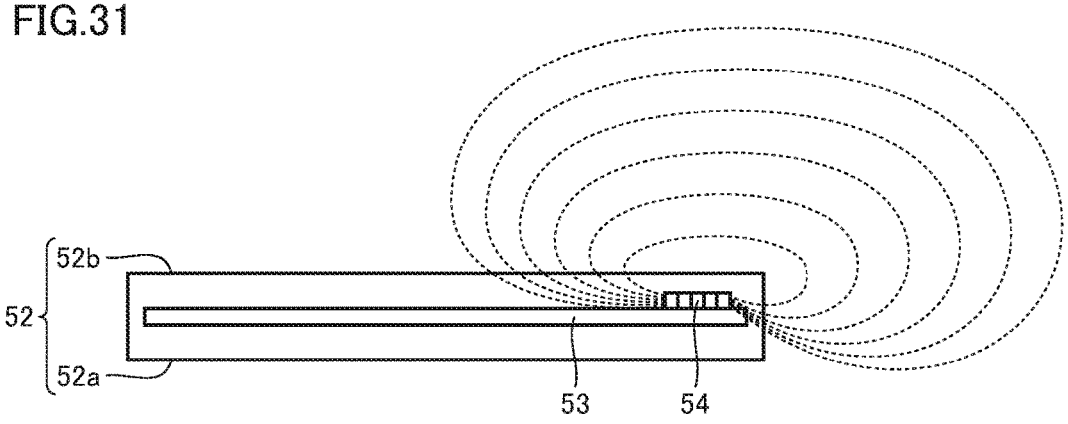
FIG. 31 is an explanatory diagram of a manner of generation of magnetic field from a stack-type inductor element included in the communication device.
Figure 32:
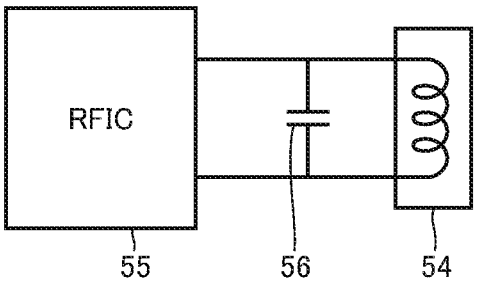
FIG. 32 is a circuit diagram of the communication device.

FIG. 30 shows one example of a communication device. This communication device is a portable communication terminal 51. FIG. 30 is a perspective transparent diagram of portable communication terminal 51 mainly viewed from a back side. Portable communication terminal 51 includes a housing 52. In FIG. 30, a back side portion 52*b* which is a portion of housing 52 is seen in an upper side. A printed circuit board 53 is accommodated in housing 52. In the vicinity of one side of printed circuit board 53, a stack-type inductor element 54 constructed as described so far is located. In this example, stack-type inductor element 54 is placed in a surface facing the back side of portable communication terminal 51, of two main surfaces of printed circuit board 53. A stack-type inductor element having an axis of winding in the longitudinal direction of the stack like stack-type inductor element 10 shown in FIGS. 1 to 5 was used as stack-type inductor element 54. FIG. 31 shows portable communication terminal 51 viewed from a side. Housing 52 includes a front side portion 52*a* and back side portion 52*b*. Stack-type inductor element 54 placed at an end portion of printed circuit board 53 generates magnetic field intensity distribution as shown in FIG. 31. This magnetic field allows portable communication terminal 51 to establish near field communication (also referred to as "NFC"). It is noted that a circuit as shown in FIG. 32 is configured in portable communication terminal 51 serving as the communication device. Namely, this communication device includes stack-type inductor element 54 and a radio frequency integrated circuit (also referred to as an "RFIC") 55. When viewed from RFIC 55, a capacitor 56 is connected electrically in parallel to stack-type inductor element 54.

Figure 33:
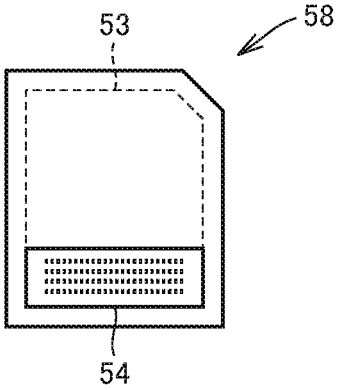
FIG. 33 is a conceptual diagram of an SD card including a stack-type inductor element.
Figure 34:
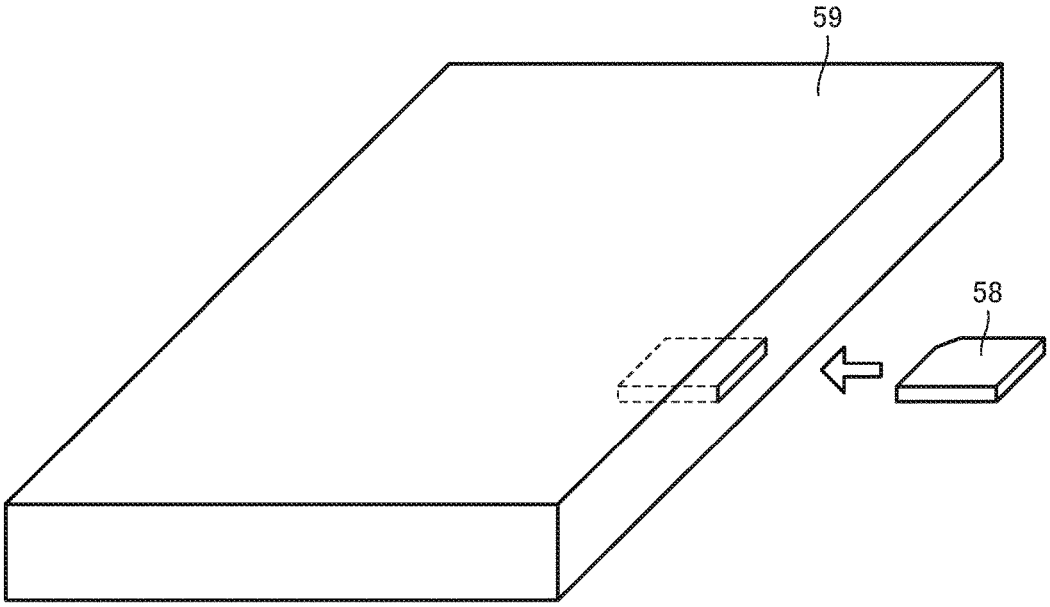
FIG. 34 is an explanatory diagram of a manner of introduction of an SD card including a stack-type inductor element in equipment.

FIG. 33 shows one example of an SD card. An SD card 58 includes printed circuit board 53 and stack-type inductor element 54 which can be used as an antenna element. A stack-type inductor element having an axis of winding in the direction of the short side of the stack was used as this stack-type inductor element 54. As shown in FIG. 34, as SD card 58 is introduced in equipment 59, equipment 59 can establish external communication based on NFC. Even though equipment 59 does not include an antenna for NFC, equipment 59 can be used as equipment including an antenna for NFC by introducing SD card 58 in equipment 59. Instead of being any card based on SD specifications, SD card 58 may be a flash memory card complying with other specifications similar thereto.

Although preferred embodiments of the present invention has been described and illustrated in detail, it should be clearly understood that the same is by way of illustration and example only and is not to be taken by way of limitation, the scope of the present invention being interpreted by the terms of the appended claims.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stack-type inductor element, comprising:

a stack including a ceramic layer, a first main surface, and a second main surface;

a coil conductor pattern including the ceramic layer;

a plurality of first pad electrodes provided on the first main surface of the stack; and a plurality of second pad electrodes provided on the second main surface of the stack to include a portion symmetric to at least a portion of the plurality of first pad electrodes; wherein the coil conductor pattern is electrically connected to at least one of the plurality of first pad electrodes, and at least one of the plurality of second pad electrodes is electrically open;

the first and second main surfaces of the stack oppose each other; and the stack is an integral fired ceramic laminate, and the first and second main surfaces of the stack respectively define uppermost and lowermost surfaces of the ceramic laminate.

2. The stack-type inductor element according to claim 1, wherein the stack has a rectangular or substantially rectangular shape when viewed in a direction of stack of the stack and the plurality of first pad electrodes are arranged in two rows along a longitudinal direction of the stack.

3. The stack-type inductor element according to claim 1, wherein a number of the plurality of first pad electrodes is three or more and a pad electrode not connected to the coil conductor pattern of the plurality of first pad electrodes is electrically open.

4. The stack-type inductor element according to claim 1, wherein the stack includes a plurality of the ceramic layers including a magnetic element layer and non-magnetic element layers superimposed on opposing main surfaces of the magnetic element layer.

5. The stack-type inductor element according to claim 1, wherein the coil conductor pattern has an axis of winding in a direction in parallel or substantially parallel to a main surface of the ceramic layer.

6. The stack-type inductor element according to claim 5, wherein the stack has a rectangular or substantially rectangular shape when viewed in a direction of stacking of the stack and the axis of winding is parallel or substantially parallel to a longitudinal direction of the rectangular or substantially rectangular shape.

7. The stack-type inductor element according to claim 1, wherein the coil conductor pattern defines a coil antenna.

8. A communication device, comprising:

the stack-type inductor element according to claim 7; and a radio frequency integrated circuit.

9. The communication device according to claim 8, wherein the stack has a thickness not greater than about 0.6 mm.

10. The stack-type inductor element according to claim 1, wherein the stack has a thickness not greater than about 0.6 mm.

11. The stack-type inductor element according to claim 1, wherein the stack includes a plurality of the ceramic layers including a magnetic element layer, and further magnetic element layers superimposed on opposing main surfaces of the magnetic element layer, the further magnetic element layers defining the first main surface and the second main surface of the stack.

* * * * *